US009078327B2

(12) United States Patent
Livschitz et al.

(10) Patent No.: US 9,078,327 B2
(45) Date of Patent: Jul. 7, 2015

(54) APPARATUS AND METHOD FOR DIMMING SIGNAL GENERATION FOR A DISTRIBUTED SOLID STATE LIGHTING SYSTEM

(71) Applicant: Luxera, Inc., Fremont, CA (US)

(72) Inventors: Leonard Simon Livschitz, San Ramon, CA (US); Anatoly Shteynberg, San Jose, CA (US); Vladimir Y. Dvadnenko, Kharkov (UA)

(73) Assignee: Luxera, Inc., San Ramon, CA (US)

( * ) Notice: Subject to any disclaimer, the term of this patent is extended or adjusted under 35 U.S.C. 154(b) by 78 days.

(21) Appl. No.: 14/057,200

(22) Filed: Oct. 18, 2013

(65) Prior Publication Data

US 2014/0042933 A1 Feb. 13, 2014

Related U.S. Application Data

(63) Continuation-in-part of application No. 13/664,068, filed on Oct. 30, 2012.

(60) Provisional application No. 61/606,837, filed on Mar. 5, 2012.

(51) Int. Cl.
*H05B 33/08* (2006.01)

(52) U.S. Cl.
CPC ..... *H05B 33/0848* (2013.01); *H05B 33/0818* (2013.01); *H05B 33/0851* (2013.01)

(58) Field of Classification Search
None
See application file for complete search history.

(56) References Cited

U.S. PATENT DOCUMENTS

| | | | | |
|---|---|---|---|---|
| 6,218,787 | B1 * | 4/2001 | Murcko et al. | 315/194 |
| 2004/0240235 | A1 * | 12/2004 | Min | 363/23 |
| 2005/0093463 | A1 * | 5/2005 | Jang et al. | 315/160 |
| 2007/0007902 | A1 * | 1/2007 | Lu | 315/209 R |
| 2009/0085500 | A1 * | 4/2009 | Zampini et al. | 315/297 |
| 2010/0244709 | A1 * | 9/2010 | Steiner et al. | 315/158 |
| 2010/0289430 | A1 * | 11/2010 | Stelzer et al. | 315/307 |
| 2011/0115399 | A1 * | 5/2011 | Sadwick et al. | 315/287 |
| 2011/0169426 | A1 * | 7/2011 | Sadwick et al. | 315/307 |

* cited by examiner

*Primary Examiner* — Crystal L Hammond
(74) *Attorney, Agent, or Firm* — Nancy R. Gamburd; Gamburd Law Group LLC

(57) ABSTRACT

Exemplary systems, methods and apparatuses for providing dimming in a distributed solid-state lighting system are disclosed. An exemplary dimming signal generator is coupleable to a controller or a current generator for a plurality of LEDs, and includes a first resistive voltage divider to sense an input DC voltage; a current sensor to sense a current level of the plurality of LEDs; a first operational amplifier to compare the sensed input DC voltage to a reference voltage level and to provide a comparator output signal; and a current path to combine the comparator output signal with the sensed LED current level to provide a combined signal for current level feedback for control of the LED current level. The dimming signal generator may optionally include other components to generate a PWM signal and also to provide a resistive network to divert LED current in response to the comparator output signal.

25 Claims, 27 Drawing Sheets

100E

170

150N

APPARATUS AND METHOD FOR DIMMING SIGNAL GENERATION FOR A DISTRIBUTED SOLID STATE LIGHTING SYSTEM

CROSS-REFERENCE TO RELATED APPLICATIONS

This application is continuation-in-part of and claims priority to U.S. patent application Ser. No. 13/664,068, filed Oct. 30, 2012, inventors Vladimir Korobov et al., entitled "Dimmable Solid State Lighting System, Apparatus and Method, with Distributed Control and Intelligent Remote Control", which is a conversion of and claims priority to U.S. Provisional Patent Application Ser. No. 61/606,837, filed Mar. 5, 2012, inventors Vladimir Korobov et al., entitled "A Power Control Unit for Power Supply to Driverless LED Lighting Apparatuses", which are commonly assigned herewith, the entire contents of which are incorporated herein by reference with the same full force and effect as if set forth in their entireties herein, and with priority claimed for all commonly disclosed subject matter.

FIELD OF THE INVENTION

The present invention in general is related to providing power through a centralized host power source to a plurality of distributed solid state lighting devices, such as bulbs and luminaires having light emitting diodes ("LEDs"), with dimming capabilities.

BACKGROUND OF THE INVENTION

Electrical lighting devices of many kinds, shapes and operational principles and capabilities, have gone through various generations of development since Edison's first incandescent electric light bulb. Today it is commonplace to find incandescent, Halogen and compact fluorescent light ("CFL") bulbs of all forms and shapes, as well as the beginning of a more modern kind of an electric lighting device that is based on light emitting diodes (LEDs). Such modern electric lighting devices can be found, for example, in the form of LED bulbs, LED luminaires, and the like. While the initial cost of such LED electric lighting devices may be higher than some of the other existing lighting solution, these costs may be offset due to the much longer lifetime of LED electric lighting devices and their significantly lower energy consumption costs. In addition, LED-based lighting generally provides better color rendering than CFL bulbs, i.e., a better quality of light, and are more environmentally friendly, both having many recyclable components and lacking the hazardous disposal issues of CFL bulbs.

Prior art LED bulbs and systems, however, tend to be overly complicated and typically incompatible with existing dimmer switches. Some require control methods that are complex, some are difficult to design and implement, and others require many electronic components. A large number of components results in an increased cost and reduced reliability. Many LED drivers utilize a current mode regulator with a ramp compensation in a pulse width modulation ("PWM") circuit. Other attempts provide solutions outside the original power converter stages, adding additional feedback and other circuits, rendering the LED driver even larger and more complicated.

For example, each individual, typical prior art LED bulb includes, in addition to the LEDs themselves, co-located LED driver circuitry comprising an AC/DC rectifier, a DC/DC converter, a current source, complicated circuitry for analog and PWM dimming, an additional dummy load for compatibility with existing triac-type dimmer switches, and additional feedback circuitry. A typical dummy load and special circuitry is required to support stable operation of a dimmer switch by providing a load to the dimmer during turn on, typically at a frequency of 60 Hz or 120 Hz, and reduces energy conversion efficiency. The significant gap between the high voltages of an input AC voltage and the lower DC voltages required for LEDs needs complex power conversion circuitry which may have as many as forty to seventy components, for example, with additional 10%-15% power losses from the conversion. Also for example, a dimmable LED driver may easily have 30% more circuitry than a nondimmable LED driver, and requires considerably more engineering resources to develop. In addition, a typical triac dimmer presents a comparatively poor interface to an AC line for solid state lighting, corrupting the power factor, introducing additional, nonfundamental harmonics, creating electromagnetic interference ("EMI") and audio noise problems, and increasing the input RMS current, further requiring corresponding increases in the value of service circuit breakers.

As a consequence, a need remains for a comparatively lower cost solution to provide LED-based lighting, using an apparatus, method and system suitable for replacing the problematic triac dimmer switches and other legacy wall-mounted switches, while simultaneously allowing the use of LED bulbs and luminaires which either utilize new interface standards or are compatible with existing or legacy interface standards, such as typical Edison-based sockets and interfaces, e.g., E12, E14, E26, E27, or GU-10 lighting standards. Such an apparatus, method and system should provide the capability for dimmable LED-based lighting, including remotely controlled dimming and color control, using LED bulbs and luminaires having comparatively few components, allowing lower cost manufacturing and corresponding savings to the consumer. Such an apparatus, method and system should provide comparative ease of use for a consumer, both for installation and bulb replacement.

Such an apparatus, method and system should also provide a wide range of dimming capability (i.e., depth of dimming), and be comparatively simple to implement using comparatively low cost components. Dimming in such lighting system could be executed, for example, by analog or pulse width modulation ("PWM") light regulation, should be capable of use with different types and qualities of LED bulbs, generally should be free of any significant flicker or other stroboscopic effects, and further should operate without causing electromagnetic interference. Such dimming should also be compatible with typical, widely-used interfaces or controllers. A need remains for an accurate dimming apparatus which provides a considerable depth of dimming, without complicated digital or analog controllers.

SUMMARY OF THE INVENTION

The exemplary embodiments of the present invention provide numerous advantages. Exemplary embodiments provide a comparatively lower cost solution to provide LED-based lighting. Various exemplary or representative apparatuses, methods and systems are disclosed which are suitable for replacing the problematic triac dimmer switches and other legacy wall-mounted switches. Various exemplary or representative apparatuses, methods and systems are disclosed which further provide for the use of LED bulbs and luminaires which either utilize new interface standards or are compatible with existing or legacy interface standards, such as typical Edison-based sockets and other standard interfaces mentioned above and below. Various exemplary embodiments provide the capability for dimmable LED-based lighting, including remotely controlled dimming and color control, using LED bulbs and luminaires having comparatively few components, allowing lower cost manufacturing and corresponding savings to the consumer. In addition, various exemplary or representative apparatuses, methods and systems are disclosed which provide comparative ease of use for a consumer, both for installation and bulb replacement.

Exemplary methods and apparatuses for a distributed solid-state lighting system are disclosed. An exemplary dimming signal generator apparatus includes an operational amplifier to receive a DC input voltage having the output inversely proportional to the input DC voltage and coupled with the current sense feedback input of the LED current source; a ramp generator, a current comparator to generate a PWM signal applied either to current sense feedback input or a dedicated PWM input of the current source in addition to the analog dimming signal to form a combined deep dimming regulation at low LED currents. To equalize currents in the different LED bulbs the transfer characteristic of input DC voltage to the LED current is formatted with flat regions allowing LED current to stay constant when input DC voltage is changing. LEDs may be bypassed with current sharing parallel networks to increase the regulation current above noise threshold and improve stability with no flickering during dimming.

An exemplary or representative distributed solid-state lighting system is disclosed, which comprises a central power source coupleable to an AC input power source, and one or more terminal lighting apparatuses coupled to and spaced apart from the central power source. An exemplary or representative central power source comprises: an AC/DC rectifier coupled to a DC/DC converter to convert the AC input power to a first DC voltage level; a central user interface to receive user input for a selected brightness level; and a central controller coupled to the DC/DC converter, the central controller to provide a first control signal to the DC/DC converter in response to the user input to provide a second DC voltage level corresponding to the selected brightness level.

In an exemplary or representative embodiment, each terminal lighting apparatus may comprise: a plurality of light emitting diodes; a current source or regulator coupled to the plurality of light emitting diodes; and a terminal controller coupled to the current source or regulator and, in response to the second DC voltage level, to provide a second control signal to the current source or regulator to provide a selected current level of the plurality of light emitting diodes corresponding to the selected brightness level.

Another exemplary or representative distributed solid-state lighting system is disclosed, comprising: a central power source coupleable to an AC input power source, the central power source to provide a selected DC output voltage level corresponding to a user selected brightness level; and one or more terminal lighting apparatuses coupled to and spaced apart from the central power source, each terminal lighting apparatus comprising: a plurality of light emitting diodes; and a current source or regulator coupled to the plurality of light emitting diodes.

Yet another exemplary or representative distributed solid-state lighting system is disclosed, comprising: one or more terminal lighting apparatuses, each terminal lighting apparatus comprising a plurality of light emitting diodes coupled to a current source or regulator; and a central power source coupleable to an AC input power source and coupled to and spaced apart from the one or more terminal lighting apparatuses, the central power source to provide a selected DC output voltage level to the one or more terminal lighting apparatuses. In various exemplary or representative embodiments, the selected DC output voltage level corresponds to a user selected brightness level.

In various exemplary or representative embodiments, for example, the central controller is to determine the second DC voltage level Vout as:

$$V\text{out}=\rho\Delta V\text{outmax}+V\text{outmin}$$

in which "ρ" is a user selectable brightness level and corresponds to $$\rho = \frac{I_{out}}{I_{outn}},$$

ΔVoutmax=Voutmax−Voutmin, Iout is the selected current level of the plurality of light emitting diodes for one or more terminal lighting apparatuses, Ioutn is the nominal current level of the plurality of light emitting diodes for one or more terminal lighting apparatuses, Voutmax=Vinmax in which Vinmax is the maximum input voltage to the one or more terminal lighting apparatuses, and Voutmin=Vinmin in which Vinmin is the minimum input voltage to the one or more terminal lighting apparatuses.

Also in various exemplary or representative embodiments, for example, the terminal controller is to determine the LED current Iout as proportional to the input voltage Vin, in which Iout is the selected current level of the plurality of light emitting diodes for the terminal lighting apparatus having the terminal controller, and Vin the sensed input voltage of the terminal lighting apparatus. Such proportionality may be linear or nonlinear, as described in greater detail below. In various exemplary or representative embodiments, the terminal controller is to determine the LED current Iout as linearly proportional to the input voltage Vin, namely, Iout=μVin, in which t is a linear transfer function, Iout is the selected current level of the plurality of light emitting diodes for the terminal lighting apparatus having the terminal controller, and Vin the sensed input voltage of the terminal lighting apparatus.

In another exemplary or representative embodiment, also for example, the terminal controller is to determine the LED current Iout as linearly proportional to the input voltage Vin, namely, Iout=μVin, where μ is a linear transfer function, $$\mu = \frac{(V_{in} - V_{inmin})I_{outn}}{\Delta V_{inmax} V_{in}},$$

in which ΔVinmax=Vinmax−Vinmin, Iout is the selected current level of the plurality of light emitting diodes for one or more terminal lighting apparatuses, Ioutn is the nominal current level of the plurality of light emitting diodes for one or more terminal lighting apparatuses, Vinmax is the maximum input voltage to the one or more terminal lighting apparatuses, Vinmin is the minimum input voltage to the one or more terminal lighting apparatuses, and Vin the sensed input voltage of the terminal lighting apparatus.

In a selected exemplary or representative embodiment, the central user interface further comprises a scanner to scan a plurality of machine-readable encoded fields. Also for example, the plurality of machine-readable encoded fields may comprise data encoding a plurality of operational parameters for a given terminal lighting apparatus, such as any of the various Vinmax, Vinmin, and ΔVinmax parameters mentioned above. In various exemplary or representative embodiments, the central controller further is to utilize the plurality of operational parameters to determine the second DC voltage level provided to the one or more terminal lighting apparatuses.

In various exemplary or representative embodiments, the plurality of operational parameters comprise at least two operational parameters selected from the group consisting of: a maximum input voltage, a minimum input voltage, a maximum input current, a minimum input current, a nominal power level, a voltage level at a nominal current level, a minimum dimming level, an adjustable color temperature range, a unique identifier, and combinations thereof.

In an exemplary or representative embodiment, a current source or regulator comprises: a fuse; and a thermal current regulator.

In another exemplary or representative embodiment, a current source or regulator comprises a converter selected from the group consisting of: a buck converter; a boost converter; a buck-boost converter; a flyback converter; a sepic converter; and combinations thereof.

In yet another exemplary or representative embodiment, a current source or regulator comprises: a fuse; a current source; and a voltage divider to provide an operating voltage to the current source.

In an exemplary or representative embodiment, a terminal lighting apparatus may further comprise: a terminal controller coupled to the current source or regulator and, in response to the second DC voltage level, provides a second control signal to the current source or regulator to provide a selected current level of the plurality of light emitting diodes corresponding to the selected brightness level.

In another exemplary or representative embodiment, the plurality of light emitting diodes further comprise a plurality of series-connected light emitting diodes forming a plurality of channels of light emitting diodes, each channel corresponding to a different emission color of light emitting diodes, and wherein each terminal lighting apparatus further comprises: a remote user interface to receive user input for a selected emission color or color temperature of a plurality of emission colors and color temperatures.

In yet another exemplary or representative embodiment, a system may further comprise: an inverter to convert the second DC voltage level to an AC voltage level having a frequency in the range of about 500 Hz to 90 kHz. For such an exemplary or representative embodiment, a current source or regulator may comprise: a transformer; and a rectifier.

As another exemplary or representative embodiment, the plurality of light emitting diodes may be coupled in series to form a series-connected current path and the current source or regulator may comprise: a transformer; a rectifier; and a plurality of switches coupled to the plurality of light emitting diodes to switch a selected light emitting diode in or out of the series-connected current path.

Exemplary or representative methods of providing power to a spatially-distributed plurality of terminal lighting apparatuses, each comprising a plurality of light emitting diodes, are also disclosed. An exemplary or representative method comprises: receiving a selected brightness level through a user interface; using a central controller, determining a dimming level "ρ"; using a central controller, determining an output voltage or output current level; rectifying an input AC voltage (current) and providing corresponding DC output voltage and current levels; and monitoring output voltage or output current levels and providing a first feedback signal to maintain the output voltage or output current level at the determined level.

In an exemplary or representative method embodiment, the output voltage is calculated as Vout=ρΔVoutmax+Voutmin, in which "ρ" is a user selectable brightness level and corresponds to $$\rho = \frac{I_{out}}{I_{outn}},$$

ΔVoutmax=Voutmax−Voutmin, Iout is the selected current level of the plurality of light emitting diodes for one or more terminal lighting apparatuses, Ioutn is the nominal current level of the plurality of light emitting diodes for one or more terminal lighting apparatuses, Voutmax=Vinmax in which Vinmax is the maximum input voltage to the one or more terminal lighting apparatuses, and Voutmin=Vinmin in which Vinmin is the minimum input voltage to the one or more terminal lighting apparatuses.

An exemplary or representative method may further comprise: using an input scanner, receiving a plurality of operational parameters corresponding to a selected terminal LED lighting apparatus. For example, the plurality of operational parameters may be encoded in a UPC-barcode or QR code format.

An exemplary or representative method may further comprise: receiving an input voltage; using a terminal controller and using the received input voltage level, calculating or determining an LED current level Iout for the plurality of light emitting diodes of a selected terminal lighting apparatus of the plurality of terminal lighting apparatuses; setting the LED current level to the value of Iout; and monitoring the LED current level and providing a second feedback signal to maintain the LED current level at the determined level Iout.

In another exemplary or representative embodiment, a method is disclosed for dimming a brightness level of a terminal lighting apparatus, comprising a plurality of light emitting diodes, with the exemplary or representative method comprising: receiving an input voltage at the terminal lighting apparatus; using a terminal controller and using the received input voltage level, calculating or determining an LED current level Iout; setting the LED current level to the value of Iout; and monitoring the LED current level and providing a feedback signal to maintain the LED current level at the determined level Iout.

For example, the LED current level Iout may be calculated as Iout=μVin, where μ is a selected transfer function, Iout is the selected current level of the plurality of light emitting diodes, and Vin the sensed input voltage of the selected terminal lighting apparatus, as mentioned above. Also for example, μ may be a linear transfer function, such as $$\mu = \frac{(V_{in} - V_{inmin})I_{outn}}{\Delta V_{inmax} V_{in}},$$

or μ may be a nonlinear transfer function, as mentioned above and as further described below.

In another exemplary or representative embodiment, the LED current level Iout is determined using the sensed value of Vin as an index into a look up table stored in memory.

An exemplary or representative kit for a distributed solid-state lighting system is also disclosed. For example, such a kit may comprise: a central power source and one or more terminal lighting apparatuses. Such a central power source may comprise: an AC/DC rectifier coupled to a DC/DC converter to convert an AC input power to a first DC voltage level; a central user interface to receive user input for a selected brightness level; and a central controller coupled to the DC/DC converter, the central controller to provide a first control signal to the DC/DC converter in response to the user input to provide a second DC voltage level corresponding to the selected brightness level. Each terminal lighting apparatus may comprise: a plurality of light emitting diodes; a current source or regulator coupled to the plurality of light emitting diodes; and a terminal controller coupled to the current source or regulator and, in response to the second DC voltage level, to provide a second control signal to the current source or regulator to provide a selected current level of the plurality of light emitting diodes corresponding to the selected brightness level.

In an exemplary or representative kit, for example, each terminal lighting apparatus is embodied as an LED bulb or luminary having an interface compatible with an interface standard selected from a group consisting of: an E12 lighting standard, an E14 lighting standard, an E26 lighting standard, an E27 lighting standard, a GU-10 lighting standard, and combinations thereof.

Another exemplary or representative embodiment provides a dimming signal generator coupleable to a controller or a current generator for a plurality of light emitting diodes (LEDs), the exemplary or representative dimming signal generator comprising: a first resistive voltage divider to sense an input DC voltage; a current sensor to sense a current level of the plurality of LEDs; a first operational amplifier coupled to the first resistive voltage divider, the first operational amplifier to compare the sensed input DC voltage to a reference voltage level, and to provide a comparator output signal; and a current path coupled to an output of the first operational amplifier to combine the comparator output signal with the sensed LED current level to provide a combined signal for current level feedback for control of the LED current level.

In an exemplary or representative embodiment, the dimming signal generator may further comprise: a ramp signal generator; and a second operational amplifier coupled to the ramp signal generator and to the output of the first operational amplifier, the second operational amplifier to provide a pulse width modulated signal. In an exemplary or representative embodiment, the second operational amplifier is further coupled to an input of the controller to provide the pulse width modulated signal directly to the controller for pulse width modulation of the LED current. In another exemplary or representative embodiment, the second operational amplifier is further coupled to the current path to combine the pulse width modulated signal into the combined signal.

In an exemplary or representative embodiment, the second operational amplifier may compare the ramp signal with the comparator output signal to generate the pulse width modulated signal.

In another exemplary or representative embodiment, the dimming signal generator may further comprise: a resistive network coupleable in parallel with the plurality of LEDs; a second resistive voltage divider coupled to the output of the first operational amplifier; and a switch coupled to the resistive network and to the second resistive voltage divider to divert current from the plurality of LEDs in response to the comparator output signal. For example, the switch may be a MOSFET or a bipolar transistor.

In an exemplary or representative embodiment of the dimming signal generator, the comparator output signal is inversely proportional to the sensed input DC voltage level. For example, when the combined signal is greater than the sensed LED current level, it will cause a decrease in the LED current level and provide dimming of the LEDs.

Another exemplary or representative embodiment provides a dimming signal generator coupleable to a controller or a current generator for a plurality of light emitting diodes (LEDs), the dimming signal generator comprising: a first resistive voltage divider to sense an input DC voltage; a current sensor to sense a current level of the plurality of LEDs; a first operational amplifier coupled to the first resistive voltage divider, the first operational amplifier to compare the sensed input DC voltage to a reference voltage level, and to provide a comparator output signal; a ramp signal generator; and a second operational amplifier coupled to the ramp signal generator and to the output of the first operational amplifier, the second operational amplifier to compare the ramp signal with the comparator output signal to generate a pulse width modulated signal; and a current path coupled to an output of the first operational amplifier to combine the comparator output signal with the sensed LED current level to provide a combined signal for current level feedback for control of the LED current level.

Another exemplary or representative embodiment provides a light emitting apparatus comprising: a plurality of light emitting diodes (LEDs); a current generator coupled to the plurality of LEDs; a controller coupled to the current generator; and a dimming signal generator coupled to the controller, the dimming signal generator to provide a combined signal for current level feedback for control of the LED current level.

Yet another exemplary or representative embodiment provides a method of providing brightness dimming of a plurality of light emitting diodes (LEDs), the method comprising: sensing an input DC voltage level; sensing an LED current level; using a first operational amplifier, comparing the input DC voltage level to a reference voltage and generating a comparator output signal; combining the comparator output signal with the sensed LED current level and pulse width modulation signal to form a combined signal; providing the combined signal as feedback for LED current regulation; and adjusting the LED current in response to the combined signal.

In an exemplary or representative embodiment, the method may further comprise: generating a ramp signal; using a second operational amplifier, generating a pulse width modulation signal. In an exemplary or representative embodiment, the method may further comprise providing the pulse width modulated signal directly to a controller for pulse width modulation of the LED current. In another exemplary or representative embodiment, the method may further comprise combining the pulse width modulated signal into the combined signal.

In an exemplary or representative embodiment, the step of generating the pulse width modulation signal may further comprise comparing the ramp signal with the comparator output signal. In another exemplary or representative embodiment, the step of generating the pulse width modulation signal may further comprise, using a switch, diverting current from the plurality of LEDs in response to the comparator output signal.

Numerous other advantages and features of the present invention will become readily apparent from the following detailed description of the invention and the embodiments thereof, from the claims and from the accompanying drawings.

BRIEF DESCRIPTION OF THE DRAWINGS

The objects, features and advantages of the present invention will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which:

FIG. 3, divided into

DETAILED DESCRIPTION OF REPRESENTATIVE EMBODIMENTS

Figure 1:
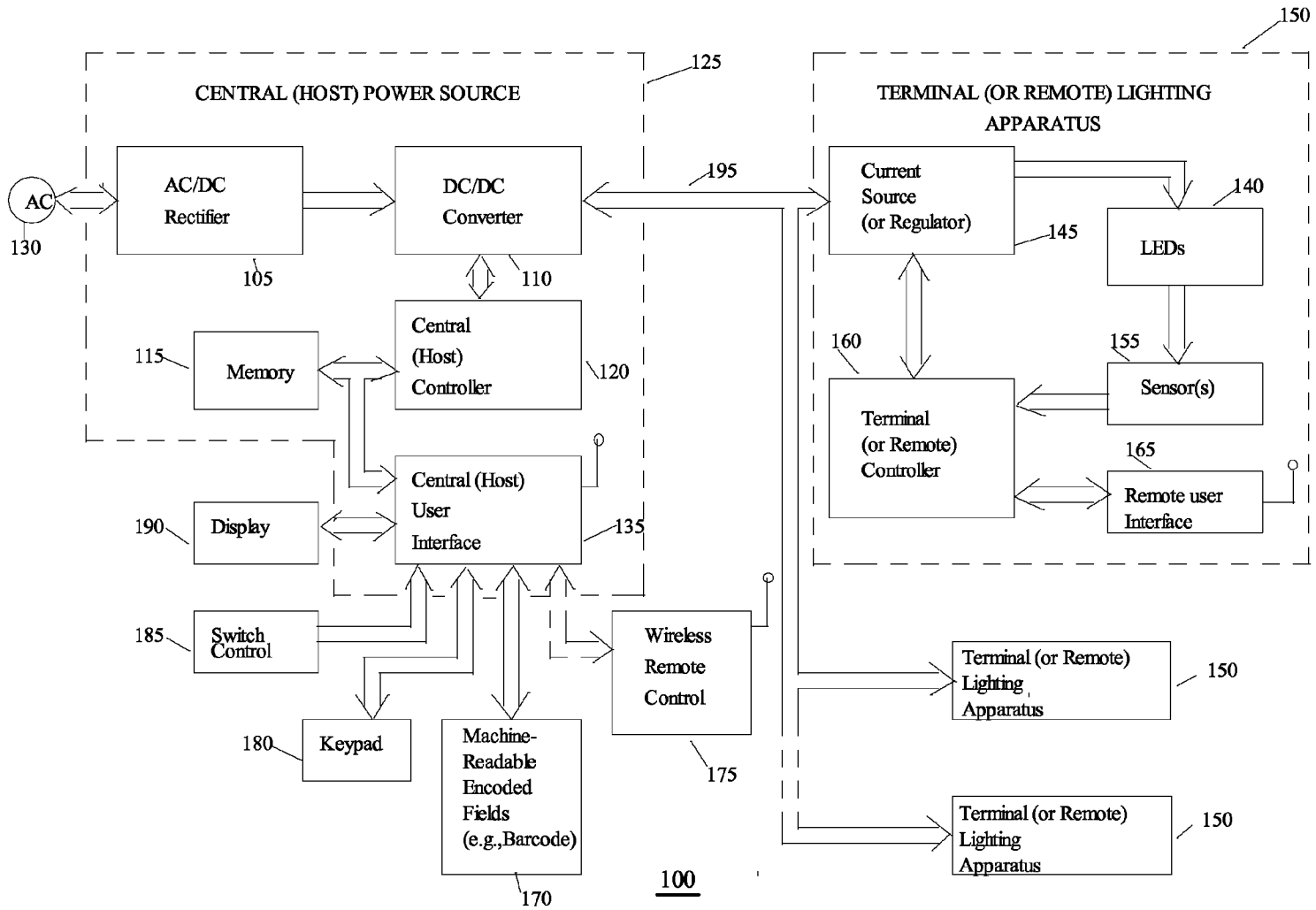
FIG. 1 is a block diagram illustrating an exemplary or representative lighting system, an exemplary or representative central (host) power source, and a first exemplary or representative terminal LED lighting apparatus.

While the present invention is susceptible of embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, illustrated in the drawings, or as described in the examples. Methods and apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

As mentioned above, an exemplary or representative distributed solid-state lighting system comprises a central power source coupleable to an AC input power source, and one or more terminal lighting apparatuses coupled to and spaced apart from the central power source. FIG. 1 is a block diagram illustrating an exemplary or representative lighting system 100, an exemplary or representative central (host) power source 125, and a first exemplary or representative terminal LED lighting apparatus 150. Referring to FIG. 1, a lighting system 100 comprises a central (host) power source 125 and one or more terminal LED lighting apparatuses 150. The one or more terminal LED lighting apparatuses 150 are coupled, in parallel, to a power transmission line 195 coupled to the central (host) power source 125. Any number of terminal LED lighting apparatuses 150 may be utilized, up to the driving capacity of the central (host) power source 125. The power transmission line 195 may be any type of power distribution line, currently known or developed in the future, with any corresponding power rating, such as a typical 2, 3, or 4 or more wire system found in a typical home, office, factory, etc., rated for 15-30 A, for example and without limitation.

For example and without limitation, in an exemplary or representative embodiment, a central (host) power source 125 may be embodied to have a legacy-compatible form factor and installed in a standard junction box to replace an existing or legacy light switch, such as a triac-based dimmer switch. Similarly, in a first alternative, terminal LED lighting apparatuses 150 may be embodied as LED bulbs and/or luminaires compatible with existing or legacy form factor and interface standards, such as typical Edison-based sockets and interfaces, e.g., E12, E14, E26, E27, or GU-10 lighting standards, and following the input of operational parameters into the central (host) power source 125 as discussed below, may be inserted into existing lighting sockets to replace legacy incandescent or CFL bulbs, also for example and without limitation. A central (host) power source 125 and a terminal LED lighting apparatuses 150, of course, are not required to be compatible with existing or legacy systems, and in other embodiments, may have any selected or desired form factor and electrical interface. Accordingly, in a second alternative, terminal LED lighting apparatuses 150 may be embodied as LED bulbs and/or luminaires which have a new and different form factor and/or interface (e.g., so that they are not inserted by mistake into a legacy socket which is not coupled to a central (host) power source 125), and following the input of operational parameters into the central (host) power source 125 as discussed below, may be inserted into corresponding lighting sockets configured to the new and different interface standard, also for example and without limitation.

The system 100, therefore, is not required to and generally does not utilize LED driver circuitry which is co-located with the LEDs, such as an AC/DC rectifier or a DC/DC converter. Rather, a distributed system 100 is implemented, with centrally located drive and control circuitry, along with some or no distributed control and regulation circuitry which may be co-located with the LEDs, depending upon the desired sophistication of the selected terminal LED lighting apparatus 150.

An exemplary or representative central (host) power source 125 typically comprises an AC/DC rectifier 105, a DC/DC converter 110, a central (host) controller 120, and a user interface 135. The AC/DC rectifier 105 is coupled to an alternating current ("AC") line 130, also referred to herein equivalently as an AC power line or an AC power source, such as a household AC line or other AC mains power source provided by an electrical utility, and converts the input AC voltage and current to DC. The AC/DC rectifier 105 may be any type of rectifier, currently known or developed in the future, such as a full-wave rectifier, a full-wave bridge, a half-wave rectifier, an electromechanical rectifier, or another type of rectifier, for example and without limitation. The direct current ("DC") voltage/current from the AC/DC rectifier 105 is then up converted to a higher DC voltage/current level or down converted to a lower DC voltage/current level using DC/DC converter 110, which may be any type of DC/DC converter having any configuration, currently known or developed in the future, such as a buck converter, a boost converter, a buck-boost converter, a flyback converter, etc., and may be operated in any number of modes (discontinuous current mode, continuous current mode, and critical conduction mode), any and all of which are considered equivalent and within the scope of the present invention, for example and without limitation.

The DC/DC converter 110 is controlled by the central (host) controller 120, which receives one or more feedback signals from the DC/DC converter 110 and which provides one or more current and/or voltage set or other control signals to the DC/DC converter 110, based upon user input, such as a selected dimming level or color temperature, and based upon the input of various operational parameters for the system 100. Based upon such user preferences and input operational parameters, as discussed in greater detail below, the central (host) controller 120 calculates or otherwise determines the voltage and/or current settings for one or more control signals provided to the DC/DC converter 110, to control the output DC voltage, current and/or power levels provided as input voltage, current and/or power levels to the terminal LED lighting apparatuses 150. For example, the DC/DC converter 110 typically includes a MOSFET (not separately illustrated) operable in a linear mode (and also typically in a saturation mode) and under the control of one or more control signals provided by the central (host) controller 120, to raise or lower the output DC voltage, current and/or power levels. The various operational parameters for the system 100, such as maximum and minimum voltage, current and/or power levels, discussed in greater detail below, are provided to the central (host) controller 120 via the user interface 135, and may be stored in a memory (typically non-volatile) that may be provided within the central (host) controller 120 or stored within an optional memory 115. Also as described in greater detail below, these various operational parameters may be varied throughout the use and lifetime of the system 100 such as, for example, when any of the one or more terminal LED lighting apparatuses 150 are removed or replaced. The central (host) controller 120 (and any optional memory 115) may be implemented as currently known or developed in the future, as described in greater detail below, such as using a processor, a controller, a state machine, combinational logic, etc., for example and without limitation.

Also illustrated in FIG. 1 are various optional input and output ("I/O") devices and articles of manufacture which may be utilized with or incorporated within a user interface 135 and/or 165 for system display and input of user preferences and operational parameters for the system 100, illustrated as wireless remote control 175, machine-readable encoded fields 170 (e.g., a non-transitory, scannable (or otherwise tangible and machine-readable) encoded article of manufacture such as a UPC-type barcode or a QR ("Quick Response") code), a display 190 (such as a touch screen display, an LED display, an LCD display, etc.), a switch control 185 (such as an on/off switch, a dimming input (e.g., dimming knob, slideable dimming control, or control button(s)), and/or a keypad 180, any of which may be implemented as currently known or developed in the future. While the user interfaces 135, 165 are illustrated as having wireless communication capability (e.g., Bluetooth, IR, IEEE 802.11, etc.), in various exemplary embodiments, any of the various controllers 120, 160 instead may be implemented to have such wireless capability for user communication.

An exemplary or representative terminal LED lighting apparatus 150 comprises one or more light emitting diodes ("LEDs") 140, and optionally and in any of various combinations, may further comprise a current source (or regulator) 145, a terminal (or remote) controller 160, one or more sensors 155, a user interface 165, and potentially an optional memory circuit (not separately illustrated, and which also may be included within a terminal (or remote) controller 160). One or more exemplary or representative terminal LED lighting apparatuses 150 are typically distributed in different locations within one or more rooms of an office, house, etc., and are coupled in parallel to power transmission line 195, each via a corresponding current source (or regulator) 145, to receive power from the DC/DC converter 110 of the central (host) power source 125. Those having skill in the electronic arts will recognize that instead of utilizing a current source (or regulator) 145, a power regulator (not separately illustrated) may be utilized equivalently, controlling the power (both current and voltage) provided to the LEDs 140. Accordingly, use of such a power regulator is considered equivalent and within the scope of the disclosure.

The current source (or regulator) 145 may be implemented to be quite simple or complex, as currently known or developed in the future, with many exemplary or representative embodiments illustrated in greater detail below, and provides power (voltage and current) to the LEDs 140, which may be any type or kind of LEDs, currently known or developed in the future, with any corresponding lumen output, color temperature, power, current and voltage ratings, and which may have any of various configurations, such as parallel, serial, and/or combinations of both. In other exemplary embodiments, the current source (or regulator) 145 may be optional and omitted, or otherwise may have so few components that regulation is minimal, such as merely providing current and temperature overload protection. The terminal (or remote) controller 160 also may include internal memory capabilities and may be implemented as currently known or developed in the future, as described in greater detail below, such as using a processor, a controller, a state machine, combinational logic, etc., also for example and without limitation. Optional sensors 155 and user interface 165 may be implemented to be simple or complex, as currently known or developed in the future, with many exemplary or representative embodiments illustrated in greater detail below. For example and without limitation, a sensor 155 may be implemented as a current sense resistor or a voltage divider. Also for example, a user interface 165 may be implemented simply to receive wireless signals (e.g., for dimming or color temperature control over the individual terminal LED lighting apparatuses 150) from a wireless remote control 175.

As illustrated in FIG. 1, the terminal LED lighting apparatus 150 is particularly suitable for dimming applications. Other embodiments of terminal LED lighting apparatuses 150 are also illustrated with fewer components (e.g., only current and temperature overload protection) and, of course, allows less control over output brightness levels. Referring to FIG. 1, the exemplary or representative terminal LED lighting apparatus 150 utilizes the terminal (or remote) controller 160 to receive feedback signals from one or more sensors 155 (such as any of LED current levels, output power, LED DC voltage levels, etc.), receive user input via remote user interface 165, and provide control signals (such as LED set current levels for a desired dimming level) to the current source (or regulator) 145. As mentioned above, the terminal LED lighting apparatus 150 may be operated in any of various modes, such as continuous current mode, discontinuous current mode, or other modes, any and all of which are within the scope of the disclosure.

The central (host) controller 120 (and, therefore, also the central (host) power source 125 and system 100) has three operational modes: a set (or set up) operational mode, an automatic operational mode, and an exchange operational mode). As discussed in greater detail below with reference to FIG. 15, in exemplary embodiments, the terminal LED lighting apparatus 150 housing and/or its labeling or packaging includes an article of manufacture comprising one or more machine-readable encoded fields 170, such as a scannable (or otherwise machine-readable) barcode or QR code, which includes a plurality of data fields encoding operational parameter information, such as minimum and maximum voltage and current levels for the selected type of terminal LED lighting apparatus 150 (or, as another option, for its incorporated string of LEDs 140). Other optional parameters may also be included within the machine-readable encoded fields 170, such as maximum or minimum power levels, maximum operating temperature, etc. During set up (or set) or exchange operational modes, such machine-readable encoded fields 170 are scanned or otherwise read through the user interface 135, a display 190, or wireless remote control 175, or another device which may function as such a remote control 175, such as a smartphone with a corresponding scanning application, as known or developed in the future. In addition to UPC barcodes and QR encoding, any other type of machine-readable data encoding (and corresponding reading and uploading method) is considered equivalent and within the scope of the disclosure, including those that merely provide an index, link, number or identification into a look up table stored in a memory and having the corresponding operational parameters. The operational parameters for each terminal LED lighting apparatus 150 are thereby uploaded into the user interface 135 and stored in a memory 115 or internal memory of a central (host) controller 120, and the corresponding terminal LED lighting apparatus 150 may then be installed (e.g., inserted into a socket) of the system 100. Similarly, during an exchange mode, operational parameters may be deleted from memory for a terminal LED lighting apparatus 150 that is being removed from the system 100, also by scanning of its machine-readable encoded fields 170, and the operational parameters of the replacement terminal LED lighting apparatus 150 are then scanned and thereby uploaded into the central (host) power source 125. This creates significant flexibility for the system 100 over its lifetime, which is not constrained by static operational parameters that are fixed by a manufacturer during device assembly, and instead may be modified and adjusted for user preferences and use of different types of terminal LED lighting apparatuses 150, including those from different manufacturers.

It should also be understood, however, that in the event machine-readable encoded fields 170 are not available for any reason, the corresponding data may be entered (and deleted) manually, such as through other devices, such as display 190 (e.g., a touchscreen) or keypad 180.

In addition, while system 100 is illustrated with the central (host) power source 125 functioning as a 2-way switch, those of skill in the art will recognize that the central (host) power source 125 may be easily extended to 3-way embodiments, 4-way embodiments, etc.

Figure 2:
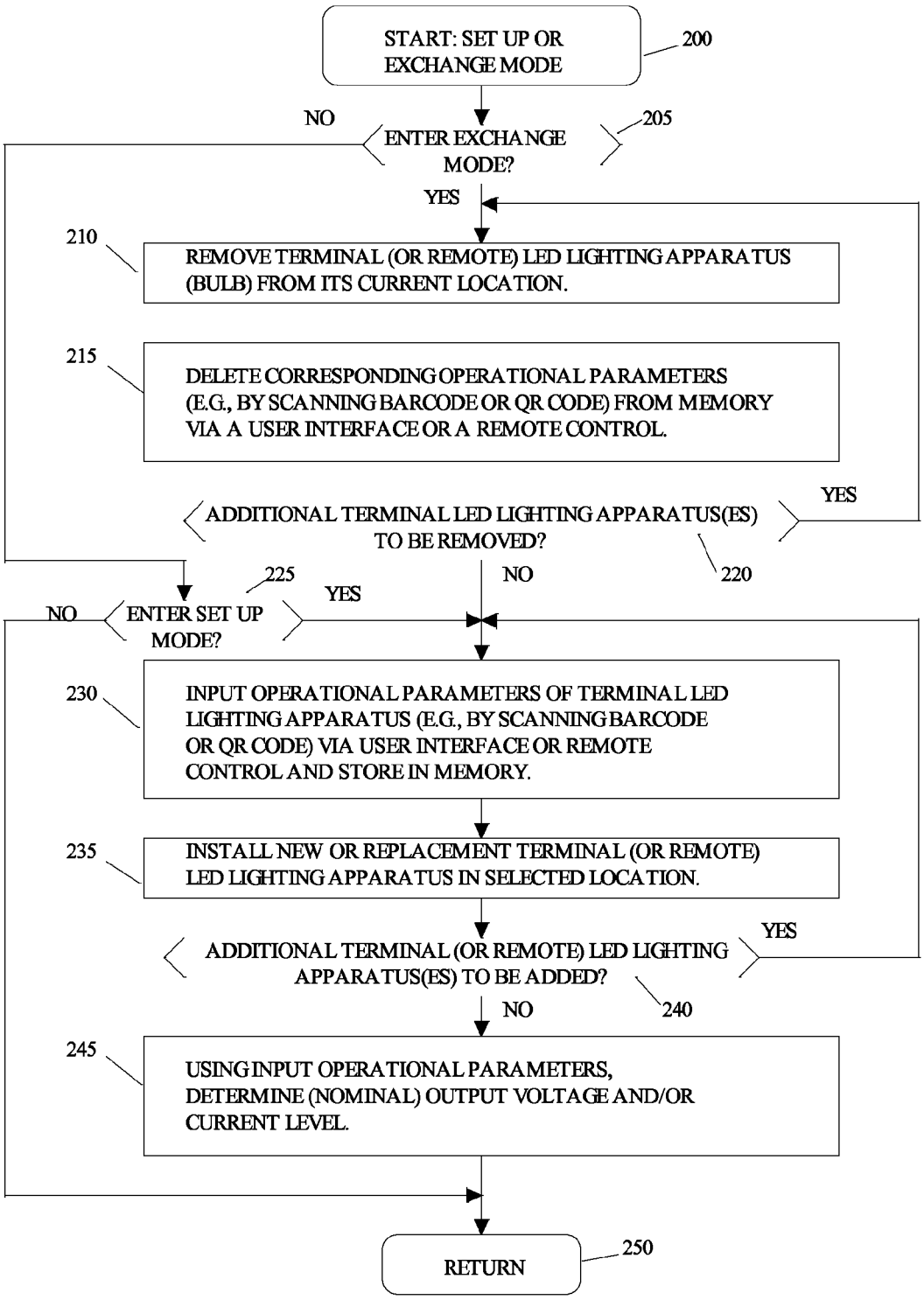
FIG. 2 is a flow diagram illustrating an exemplary or representative preoperational method for set up and exchange modes of an exemplary or representative lighting system and an exemplary or representative central (host) power source.

FIG. 2 is a flow diagram illustrating an exemplary or representative preoperational method for set up and exchange modes of an exemplary or representative lighting system 100 and an exemplary or representative central (host) power source 125. Beginning with start step 200, via user interface 135 or remote control 175, a user may have the central (host) power source 125 enter the exchange mode, step 205, such as to remove a failed LED bulb and replace it with a new one. The user may remove a terminal LED lighting apparatus 150, such as a failed LED bulb, from its current location, step 210, and delete the corresponding operational parameters from memory, such as by scanning the machine-readable encoded fields 170, step 215. When an additional terminal LED lighting apparatus 150 is to be removed, step 220, the method returns to steps 210 and 215. When all terminal LED lighting apparatuses 150 have been removed, step 220, or when the user has the central (host) power source 125 enter the set up mode in step 225, new operational parameters of a new or replacement terminal LED lighting apparatus 150 are input via user interface 135 or remote control 175 and stored in memory, such as optional memory 115 or a memory within central (host) controller 120, step 230. The user then installs a new or replacement terminal LED lighting apparatus 150, such as by screwing it into a standard socket, step 235. When an additional terminal LED lighting apparatus 150 is to be added, step 240, the method returns to step 230. When all terminal LED lighting apparatuses 150 have been added, step 240, the central (host) controller 120 may then calculate or otherwise determine the nominal output voltage, current and/or power levels to be provided by the DC/DC converter 110 and other parameters, step 245, as discussed in greater detail below, and the method may end, return step 250.

Typically, a dimming level is set by user interface 135 (manually) or by a remote control 175. In set mode, the central (host) controller 120 gets information from the machine-readable encoded fields 170 via the user interface 135 to set the maximum (and/or minimum) operational parameters of the central (host) power source 125 and saves this in the memory as a network configuration, including the number of terminal LED lighting apparatus 150*es* and their operational parameters, such as maximum voltages, current, power, etc. In exchange mode, the central (host) controller 120 gets the corresponding information on the failed terminal LED lighting apparatus 150 and the new, replacement terminal LED lighting apparatus 150, and recalculates or reconfigures the system 100 (or network) settings. Depending upon the degree of sophistication of the system 100, the information input during set and exchange modes may also include the (network) location of the particular terminal LED lighting apparatus 150 within the system 100. In automatic mode, the central (host) controller 120 performs various calculations, discussed below, provides corresponding control signals to the DC/DC converter 110, and sets the dimming level for the terminal LED lighting apparatuses 150 based on the signals from the remote control 175 or user interface 135 (e.g., which may be manually input via display 190, switch control 185, or keypad 180).

In an exemplary embodiment, the central (host) controller 120 calculates or otherwise determines the dimming level "ρ" for the plurality of terminal LED lighting apparatuses 150, in which (Equation 1):

$$\rho = \frac{I_{out}}{I_{outn}},$$

where Iout is the LED 140 current in a terminal LED lighting apparatus 150 for a user determined or selected dimming level and Ioutn is the nominal LED 140 current in a terminal LED lighting apparatus 150 with no dimming (e.g., full brightness). In turn, Iout and Ioutn are related as follows (Equation 2):

$$I_{out} = I_{outn}\left(1 - \frac{V_{inmax} - V_{in}}{V_{inmax} - V_{inmin}}\right),$$

where Vin is the input voltage to the terminal LED lighting apparatus 150, Vinmax is the maximum input voltage to the terminal LED lighting apparatus 150, Vinmin is the minimum input voltage to the terminal LED lighting apparatus 150, resulting in the dimming level "ρ" (Equation 3):

$$\rho = \left(1 - \frac{V_{inmax} - V_{in}}{V_{inmax} - V_{inmin}}\right).$$

In turn, the relationship between the input voltage to the terminal LED lighting apparatus 150 and the selected dimming level is (Equation 4):

$$V\text{in} = \rho(V_{inmax} - V_{inmin}) + V_{inmin},$$

or Equation 5:

$$V\text{in} = \rho\Delta V\text{inmax} + V\text{inmin}$$

where (Equation 6):

$$\Delta V\text{inmax} = V\text{inmax} - V\text{inmin}$$

A dimming transfer function "μ" may then be calculated or otherwise determined as (Equation 7):

$$\mu = \frac{I_{out}}{V_{in}} = \frac{\Delta V_{in} I_{outn}}{\Delta V_{inmax} V_{in}},$$

where ΔVin=Vin−Vinmin, namely, the change in input voltage provided to the terminal LED lighting apparatus 150 from the minimum voltage input to the terminal LED lighting apparatus 150, where Vin the sensed input voltage of the terminal LED lighting apparatus 150. (Equivalently, ΔVin could be defined as a change from the maximum input voltage, where ΔVin=Vinmax−Vin, namely, the change in input voltage provided to the terminal LED lighting apparatus 150 from the nominal or maximum voltage input to the terminal LED lighting apparatus 150 without dimming, also where Vin the sensed input voltage of the terminal LED lighting apparatus 150.) For example, using the calculated transfer function μ, each terminal (or remote) controller 160 may calculate or otherwise determine the current to be provided to LEDs 140 as (Equation 8):

$$I\text{out} = \mu V\text{in}.$$

As discussed in greater detail below, this relationship between input voltage and current to be provided to the LEDs 140 is quite powerful and highly novel, as dimming control can be provided to each terminal LED lighting apparatus 150 by a change in the output voltage provided by the central (host) power source 125. Sensing the input voltage Vin, the terminal (or remote) controller 160 then determines the appropriate, corresponding current level Iout to be provided to the LEDs 140, thereby raising or lowering (dimming) the output brightness level accordingly. This is very different than prior art dimming through a triac-based device, which provides dimming by clipping or eliminating a portion of the AC voltage/current provided to the lamp.

It should also be noted that while the various exemplary equations and transfer function illustrate a linear relationship between the input voltage Vin and the current level Iout to be provided to the LEDs 140, nonlinear relationships are also within the scope of the disclosure and considered equivalent (and are illustrated and discussed with reference to FIG. 4).

Assuming that voltage drop in the transmission power line 195 is negligible, the output voltage of the central (host) power source 125 can be considered to be effectively equal to the input voltage to the terminal LED lighting apparatuses 150, such that (Equations 8, 9, 10 and 11):

$$V_{out}=V_{in};$$

$$V_{outmin}=V_{inmin};$$

$$V_{outmax}=V_{inmax}; \text{ and}$$

$$\Delta V_{outmax}=\Delta V_{inmax}.$$

It should be noted, for each of these parameters, when a DC voltage and current are not being utilized, such as in the high frequency system discussed below, the voltage and current amplitudes may be utilized equivalently for these calculations. As a result, the central controller 120 may determine the second DC voltage level Vout as (Equation 12): Vout=ρΔVoutmax+Voutmin, in which "ρ" is a user selectable brightness level and corresponds to $$\rho = \frac{I_{out}}{I_{outn}},$$

ΔVoutmax=Voutmax−Voutmin, Iout is the selected current level of the plurality of light emitting diodes 140 for one or more terminal lighting apparatuses 150, Ioutn is the nominal current level of the plurality of light emitting diodes 140 for one or more terminal lighting apparatuses 150, Voutmax=Vinmax in which Vinmax is the maximum input voltage to the one or more terminal lighting apparatuses 150, and Voutmin=Vinmin in which Vinmin is the minimum input voltage to the one or more terminal lighting apparatuses 150. Similarly, the terminal controller 160 may determine the LED current Iout as linearly proportional to the input voltage Vin (Equation 13): Iout=μVin, where μ is a linear transfer function, $$\mu = \frac{(V_{in} - V_{inmin})I_{outn}}{\Delta V_{inmax} V_{in}},$$

in which ΔVinmax=Vinmax−Vinmin, Iout is the selected current level of the plurality of light emitting diodes 140 for one or more terminal lighting apparatuses 150, Ioutn is the nominal current level of the plurality of light emitting diodes 140 for one or more terminal lighting apparatuses 150, Vinmax is the maximum input voltage to the one or more terminal lighting apparatuses 150, Vinmin is the minimum input voltage to the one or more terminal lighting apparatuses 150, and Vin the sensed input voltage of the one or more terminal lighting apparatuses 150.

As part of the set up or exchange process (step 245), or upon powering on (powering up) of the system 100, the parameters Vout, Voutmin, Voutmax, and ΔVoutmax may be calculated by the central (host) controller 120 using the various input operational parameters and the number of terminal LED lighting apparatuses 150 in the system 100, or may be input via user interface 135 or remote control 175. Similarly, the parameters Ioutn, Vinmin, Vinmax and ΔVinmax (and other parameters) for one or more terminal LED lighting apparatuses 150 may be provided directly to the terminal LED lighting apparatus(es) 150 by the manufacturer as part of or otherwise during device manufacture (e.g., input and stored in a terminal (or remote) controller 160 and its associated memory (not separately illustrated)), or may be calculated by the terminal (or remote) controller 160 using its input operational parameters, or may be input via remote user interface 155 or remote control 175. As yet another alternative, during either set up (or exchange mode) or powering on, the central (host) power source 125 may transmit these values to the terminal LED lighting apparatuses 150, such as through various handshaking mechanisms and/or power line signaling.

Figure 3A:
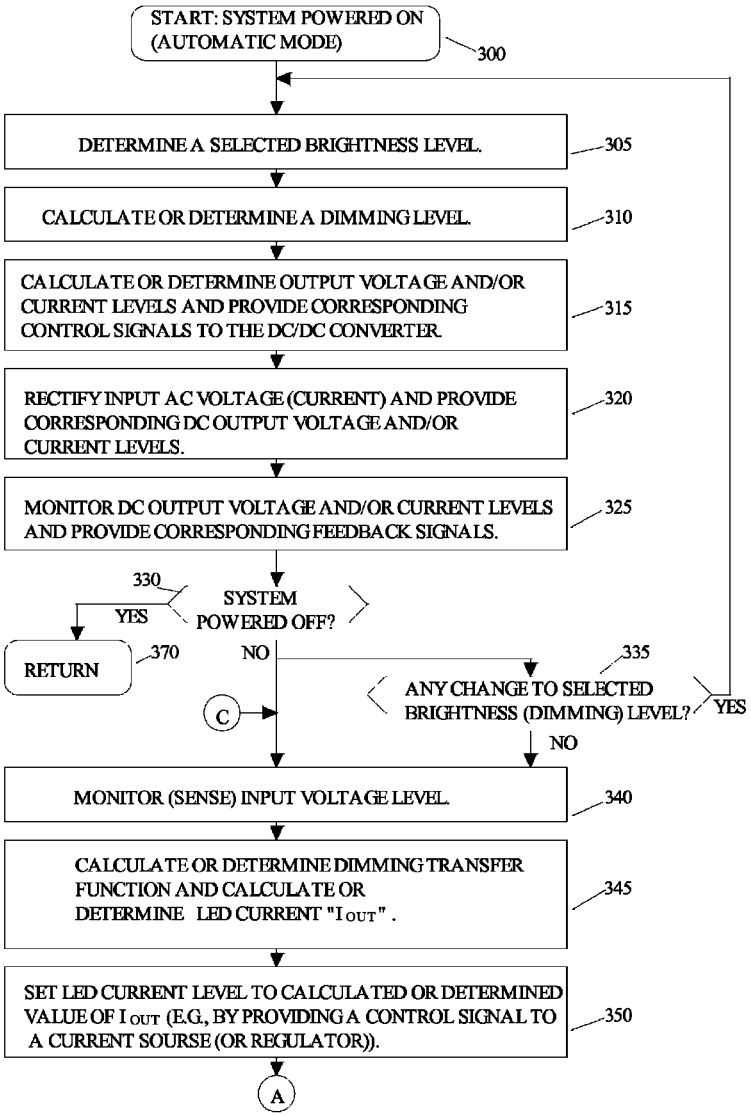
FIGS. 3A and 3B, is a flow diagram illustrating an exemplary or representative method of operating an exemplary or representative lighting system, an exemplary or representative central (host) power source, and an exemplary or representative terminal LED lighting apparatus.
Figure 3B:
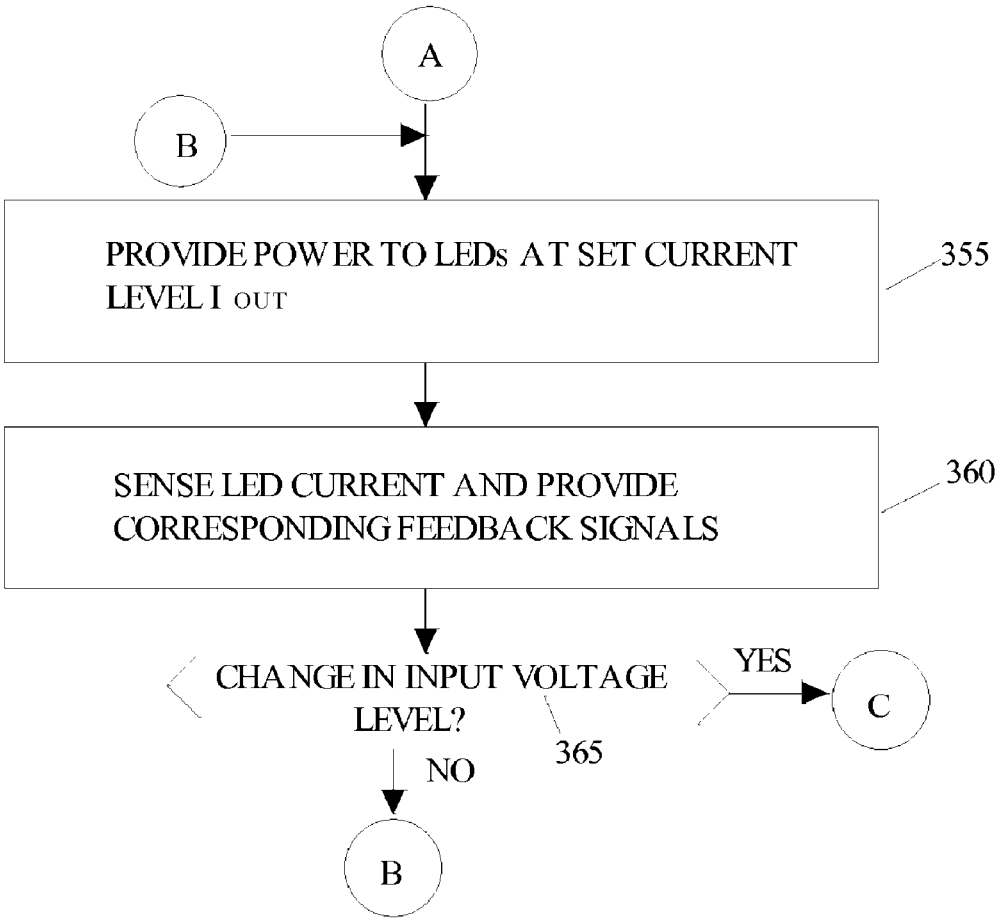

FIG. 3 is a flow diagram illustrating an exemplary or representative method of operating an exemplary or representative lighting system 100, an exemplary or representative central (host) power source 125, and an exemplary or representative terminal LED lighting apparatus 150. The automatic mode method begins, start step 300, when the system 100 is powered on by the user, and the user selects a brightness level, such as by pressing a button, flipping a switch, or moving a slideable indicator, for example and without limitation. (As part of step 300, if not performed as step 245 mentioned above, the various operational parameters mentioned above may be determined and stored in the memories of the central (host) power source 125 and the terminal LED lighting apparatus 150.) The central (host) controller 120 determines what brightness level has been selected, step 305, and calculates or determines a dimming level ρ, step 310, that corresponds to the selected brightness level. Based on the dimming level ρ, in step 315, the central (host) controller 120 determines the output voltage and/or current levels, with Vout=ρΔVoutmax+Voutmin, and provides corresponding control signals, to the DC/DC converter 110. For example, the calculated value of Vout may be provided as a reference voltage level in a feedback loop within the central (host) controller 120 or the DC/DC converter 110. The AC/DC rectifier 105 rectifies the input AC voltage and the DC/DC converter 110, using the control signals from the central (host) controller 120, provides power, as the corresponding DC output voltage and current levels, to the terminal LED lighting apparatuses 150 over power transmission line(s) 195, step 320. The central (host) controller 120 monitors the DC output voltage and current levels, and provides any feedback signals to the DC/DC converter 110 to maintain the desired DC output voltage and current levels, step 325. When the system 100 has not been powered off, step 330, the method continues, and determines whether there has been any change in the selected dimming level, step 335. When there is a change to the selected dimming level, step 335, the method iterates, returning to step 305 and repeating steps 305-330, and continues to provide the selected DC output voltage and current levels at the new dimming level. When the system 100 has been powered off, step 330, the method may end, return step 370.

As long as the system 100 has not been powered off, the method continues and the terminal LED lighting apparatuses 150 continue to receive input power from the DC/DC converter 110 at the selected DC output voltage and current levels. Continuing to refer to FIG. 3, a terminal (or remote) controller 160 monitors (senses and/or measures) the input voltage level (and/or current level) to the terminal LED lighting apparatus 150, such as through a voltage sensor, step 340, and calculates or otherwise determines the dimming transfer function μ and calculates of otherwise determines Iout, step 345. For example, the transfer function may be calculated as $$\mu = \frac{(V_{in} - V_{inmin})I_{outn}}{\Delta V_{inmax} V_{in}},$$

and the current Iout may be calculated as Iout=μVin, by digital or analog devices, as mentioned above. The terminal (or remote) controller 160 sets the LED 140 current level to the calculated value of Iout, such as by providing control signals to the current source (or regulator) 145, step 350, and the current source (or regulator) 145 provides power to the LEDs 140 at this set current level Iout, step 355. Using sensor (s) 155, the terminal (or remote) controller 160 monitors the LED 140 current (and/or voltage) levels, provides feedback signals to the current source (or regulator) 145 to adjust or maintain the LED 140 current (and/or voltage) levels at the selected Iout level (or a lower level, if needed, based on input parameters, such as maximum current levels, for example), step 360. When there has been no change in the input voltage level (and/or current level) to the terminal LED lighting apparatus 150, step 365, the method continues, returning to step 355 to continue providing power to the LEDs 140. When there is a change in the input voltage level (and/or current level) to the terminal LED lighting apparatus 150, step 365, the method returns to step 345 and iterates.

It should also be noted that instead of calculating a transfer function in step 345, a terminal (or remote) controller 160 may also be configured to utilize the sensed input voltage Vin (or corresponding current level) as an index into a look up table, stored in memory, which then provides a corresponding level of Iout which may be utilized to set the LED 140 current level. In addition, as illustrated in FIG. 4, various nonlinear transfer functions may also be utilized.

It should be noted and those having skill in the art will recognize that the steps illustrated in FIG. 3 may occur in a wide variety of orders, and may operate as simultaneous, iterative loops until the system 100 is powered off, a first loop occurring at the central (host) power source 125, and a second loop occurring at each of the terminal LED lighting apparatus 150. In addition, various steps are continuous, such as monitoring step 340, which operates as long as the system 100 is powered on. For a first loop occurring at the central (host) power source 125, for example, unless the system 100 is powered off, and unless there is a change in the dimming level, step 320 continues, in which the AC/DC rectifier 105 rectifies the input AC voltage and the DC/DC converter 110, using the control signals from the central (host) controller 120, continues to provide the same level of DC output voltage and current levels to the terminal LED lighting apparatuses 150 over power transmission line(s) 195. Also unless powered off, when there is a change in the dimming level, the method will iterate to generate new DC output voltage and current levels to the terminal LED lighting apparatuses 150, and will continue to provide this new level until the dimming level changes again or the system is powered down. Similarly, for a second loop occurring at the terminal LED lighting apparatuses 150 (generally simultaneously with the first loop once in steady state), unless there is a change in the input voltage level (and/or current level), current (and/or voltage) will continue to be provided to the LEDs 140 at the set level of Iout, with corresponding feedback control (steps 355 and 360). When there is a change in the input voltage (and/or current) level, the method will also iterate to generate a new current level Iout and provide power to the LEDs 140 at this new current level.

Figure 4:
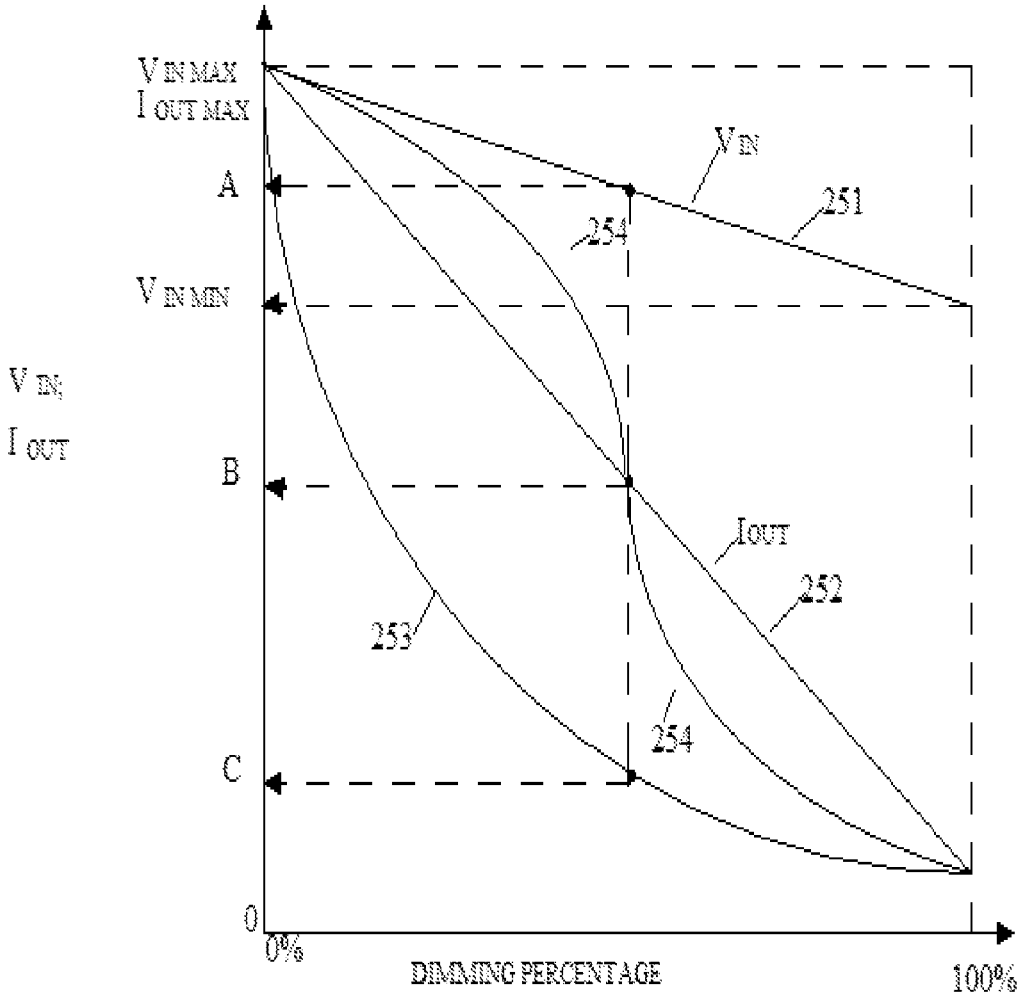
FIG. 4 is a graph illustrating exemplary or representative voltage and current waveforms for intelligent dimming using an exemplary or representative lighting system, an exemplary or representative central (host) power source, and an exemplary or representative terminal LED lighting apparatus.

FIG. 4 is a graph illustrating exemplary or representative voltage and current waveforms for intelligent dimming using an exemplary or representative lighting system 100, an exemplary or representative central (host) power source 125, and an exemplary or representative terminal LED lighting apparatus 150, and provides a useful summary of the dimming methodology described above. As discussed above, when powered on, the central (host) power source 125 will provide an output voltage corresponding to a desired dimming level, which is the input voltage Vin to the terminal LED lighting apparatus 150, and which varies between a minimum input voltage Vinmin and a maximum input voltage Vinmax, illustrated as line 251. Based upon the input voltage Vin, the terminal (or remote) controller 160 determines the level of LED 140 current Iout that provides the selected dimming level, which may be a linear relationship between Vin and Iout illustrated as line 252, or any of various nonlinear relationships, illustrated as lines 253 and 254 for example. For example, an input voltage Vin sensed at level "A", would map through the corresponding transfer function to an LED 140 current Iout having a level "B" for the linear transfer function illustrated as line 252 and also for the nonlinear (sigmoidal) transfer function illustrated as line 254, but would map through the corresponding transfer function to an LED 140 current Iout having a level "C" for the nonlinear transfer function illustrated as line 253. Those having skill in the art will recognize that there are advantages to each of these transfer functions, such as the degree of lighting control which may be provided to the user in different regions of dimming, e.g., finer control in certain percentage intervals or equal control throughout the entire 0% to 100% dimming. Using the variation in input voltage Vin, the terminal (or remote) controller 160 is able to correspondingly adjust the LED 140 current level from no (0%) dimming to 100% dimming (when the voltage level is insufficient to turn on the LEDs 140 and no current flows through the LEDs 140). In addition, such dimming of the LEDs 140 is provided without any issues of stability, flicker, or the other problems associated with prior art triac-based dimming.

Referring again to FIG. 3, those having skill in the art will also recognize that many of the illustrated steps may be omitted or varies, and will depend in large part upon the type of terminal LED lighting apparatus 150 utilized within the system 100. A wide variety of exemplary or representative types of terminal LED lighting apparatuses 150 are illustrated and discussed below with reference to FIGS. 5-14. For example, several illustrated examples of terminal LED lighting apparatuses 150 do not include any terminal (or remote) controller 160, any sensors 155, or any remote user interface 165, and for those embodiments, only steps 300, 315, 320, 325, 330 and 370 may be executed, with all other steps omitted. For these implementations, most of the lighting control is performed by the central (host) power source 125, with limited control by the terminal LED lighting apparatus 150 (e.g., current and/or temperature overload control, passive current control, etc.). For some of these embodiments, dimming may occur by varying the output voltage Vout of the central (host) power source 125, thereby increasing or decreasing LED 140 current passively within the terminal LED lighting apparatus 150.

It should also be noted that depending upon the type of terminal LED lighting apparatus 150 utilized in the system 100, different operational parameters may be utilized to determine the output voltage Vout of the central (host) power source 125, such as the minimum or the maximum current ratings of the selected terminal LED lighting apparatus 150. In addition, those having skill in the art will also recognize that while several different types of terminal LED lighting apparatuses 150 may be utilized concurrently within the system 100, in other circumstances, only one type of terminal LED lighting apparatus 150 should be selected for implementation of a selected system 100.

It should also be noted that depending upon the implementation of a system 100, different types of wiring may be utilized, in addition to power transmission lines 195, such as communication wiring, which may allow for additional data communication between and among the central (host) power source 125 and the terminal LED lighting apparatuses 150. In addition, additional control and data transmission may be provided using various power line signaling methods known or developed in the future. Also, depending upon the implementation, wireless communication may also occur between and among the central (host) power source 125 and the terminal LED lighting apparatuses 150 using the wireless capabilities which may be implemented in the user interfaces 135, 165. This additional potential for control may be utilized, for example and without limitation, for color mixing and temperature control (e.g., FIG. 14) and for differential dimming among the terminal LED lighting apparatuses 150. For example, such differential dimming may be performed using network addresses for the terminal LED lighting apparatuses 150 within the system 100 and power line signal or wireless communication.

Figure 5:
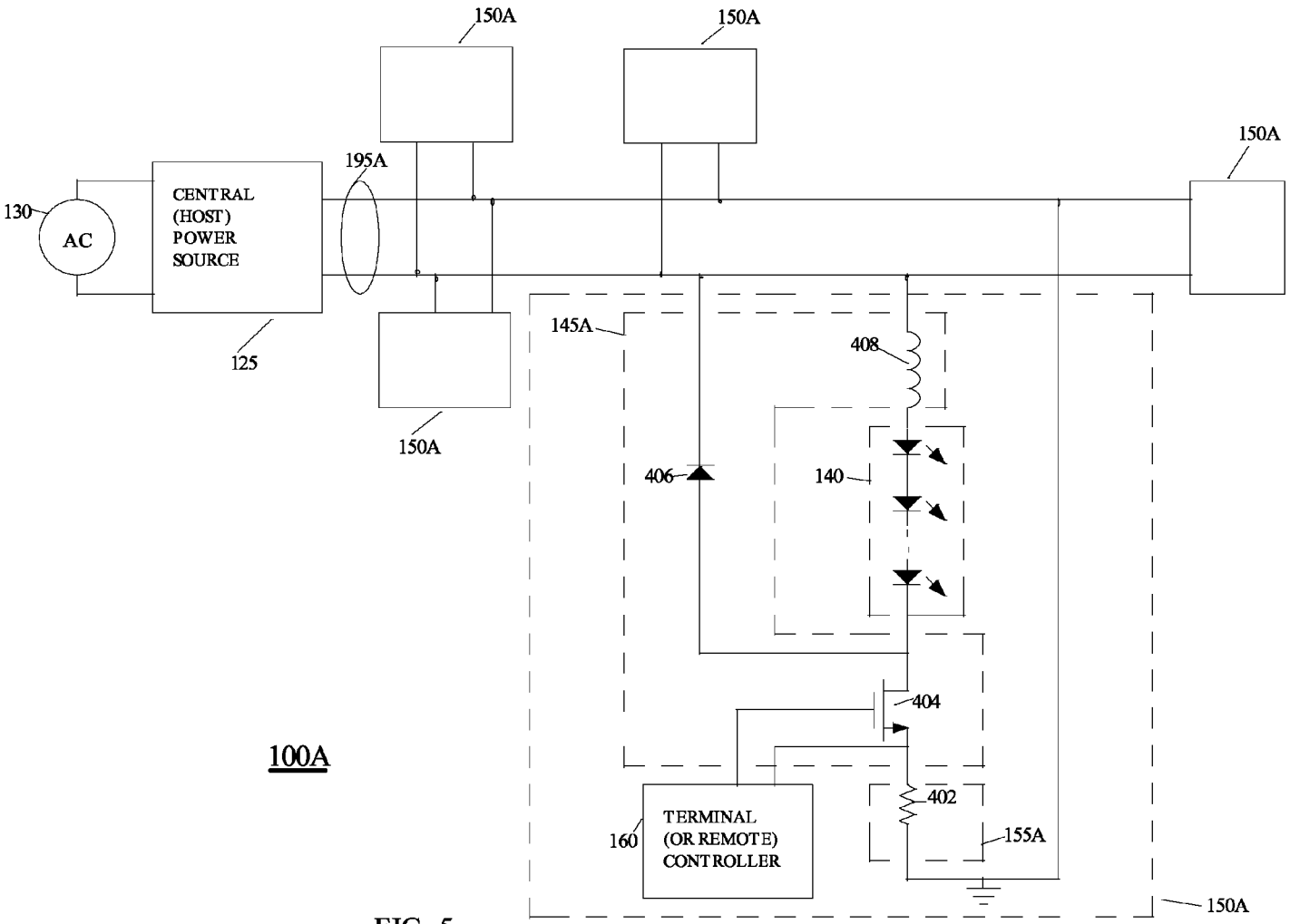
FIG. 5 is a block and circuit diagram illustrating a second exemplary or representative terminal LED lighting apparatus for use in a comparatively low voltage DC system.

FIG. 5 is a block and circuit diagram illustrating a second exemplary or representative terminal LED lighting apparatus 150A for use in a comparatively low voltage DC system 100A, in which the output voltage Vout of the central (host) power source 125 is a comparatively lower DC voltage, typically less than about 60V DC (to provide self-voltage capability), indicated by designating the power transmission line as low voltage DC lines 195A. In addition to terminal LED lighting apparatuses 150A being able to be used in such a system 100A, other types of terminal LED lighting apparatuses 150 (150F, 150G, 150H, and 150J illustrated in FIGS. 11-14) may also be utilized in a comparatively low DC voltage system 100A. As illustrated in FIG. 5, central (host) power source 125 is coupled to an AC input 130, and a plurality of terminal LED lighting apparatuses 150A are connected in parallel to the transmission lines 195A. The selection of self-powering voltage allows the terminal LED lighting apparatus 150A to employ a low voltage topology. As illustrated, the current source (or regulator) 145A utilizes a buck topology comprised of inductor 408, diode 406, and MOSFET 404, using a current sense resistor 402 as a sensor 155A, and using a terminal (or remote) controller 160. The series connected string of LEDs 140 is driven by a current regulated source, and the LEDs 140 do not require binning during manufacturing. While a buck converter is illustrated, any other type of converter may be utilized equivalently, including buck-boost, sepic, flyback, and many others currently known or developed in the future.

Figure 6:
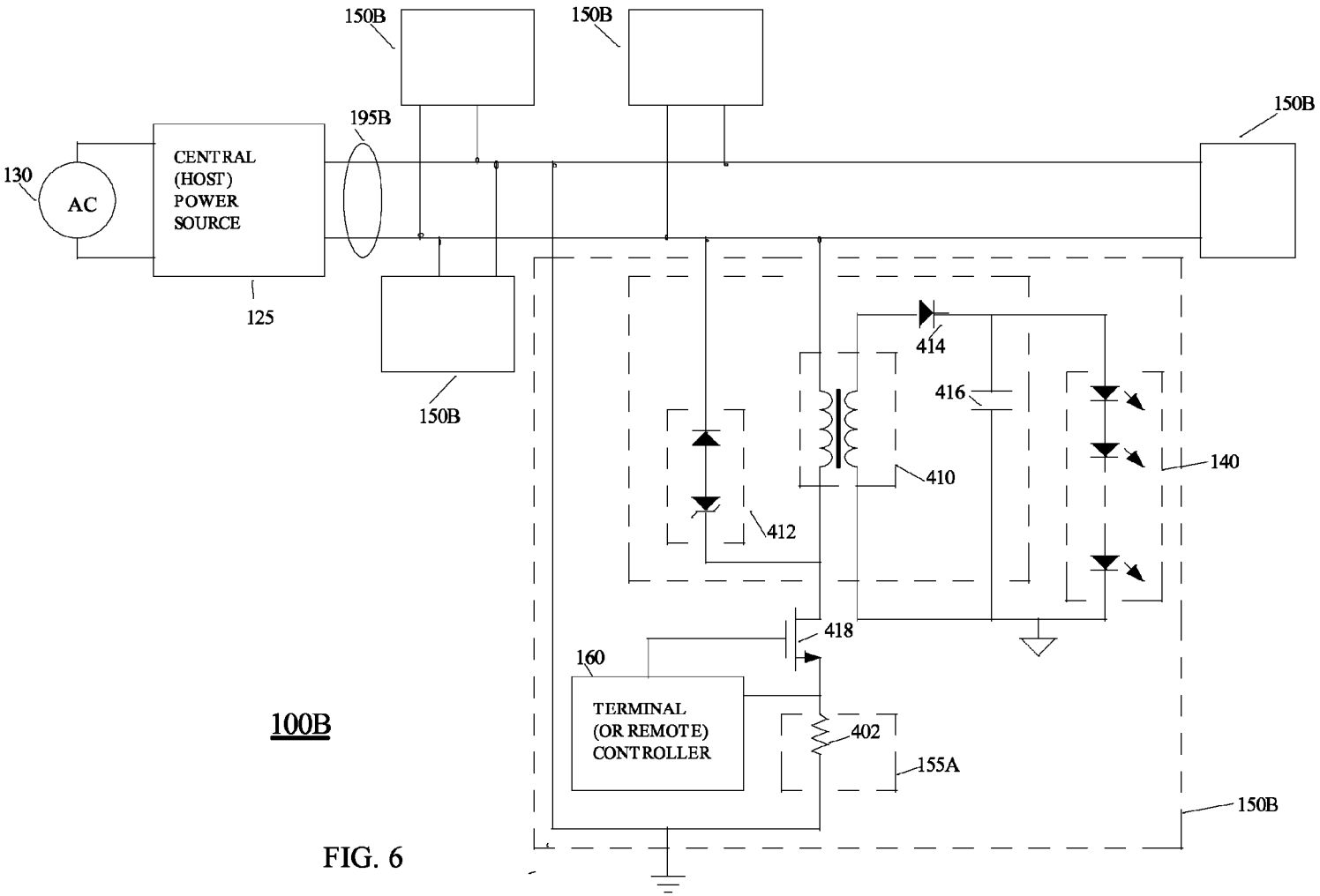
FIG. 6 is a block and circuit diagram illustrating a third exemplary or representative terminal LED lighting apparatus for use in a comparatively high voltage DC system.

FIG. 6 is a block and circuit diagram illustrating a third exemplary or representative terminal LED lighting apparatus for use in a comparatively high voltage DC system 100B, in which the output voltage Vout of the central (host) power source 125 is a comparatively higher DC voltage, in the range of about 300V, for example and without limitation, indicated by designating the power transmission lines as low voltage DC lines 195B. As illustrated in FIG. 6, central (host) power source 125 is coupled to an AC input 130, and a plurality of terminal LED lighting apparatuses 150B are connected in parallel to the transmission lines 195B. As illustrated, the current source (or regulator) 145B utilizes a high voltage flyback topology comprising transformer 410, snubber circuit 412, rectifier (diode) 414, filter capacitor 416, and MOSFET 418, using a current sense resistor 402 as a sensor 155A, and using a terminal (or remote) controller 160.

Figure 7:
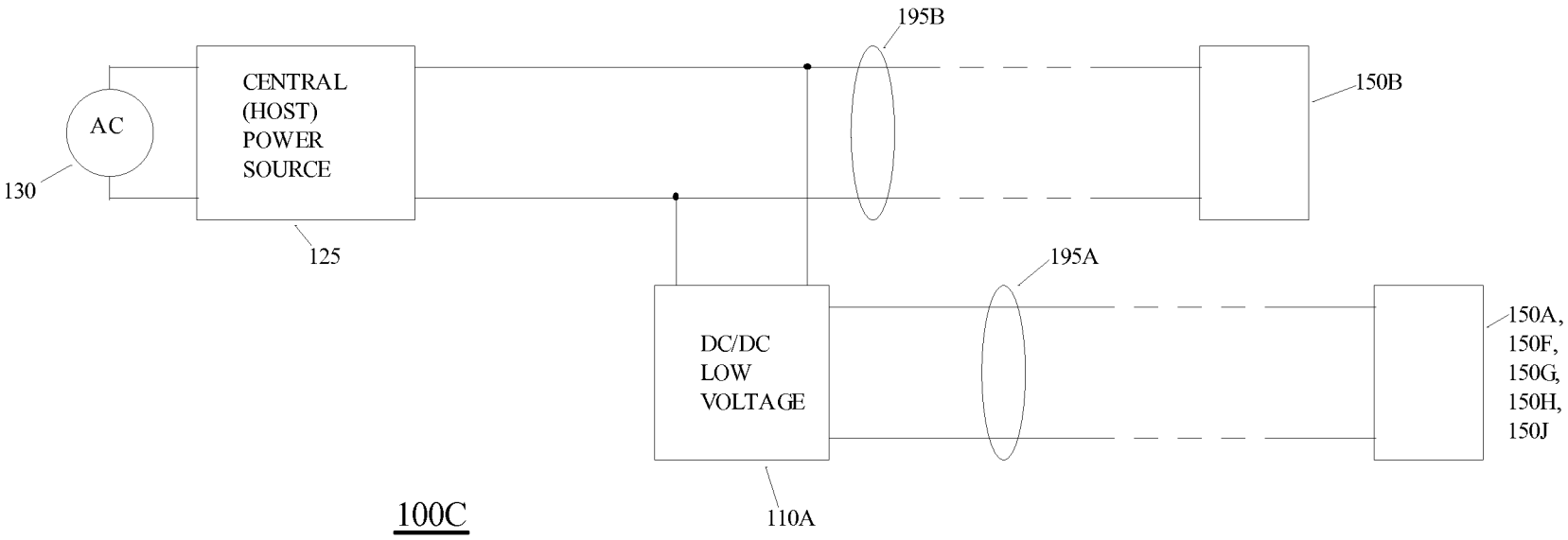
FIG. 7 is a block diagram illustrating a second exemplary or representative system having both comparatively high and low DC levels.

FIG. 7 is a block diagram illustrating an exemplary or representative system 100C having both comparatively high and low DC levels, respectively illustrated using transmission lines 195B and 195A, and with an additional DC/DC converter 110A to convert the higher voltage on lines 195B to a lower DC voltage on lines 195A.

Figure 8:
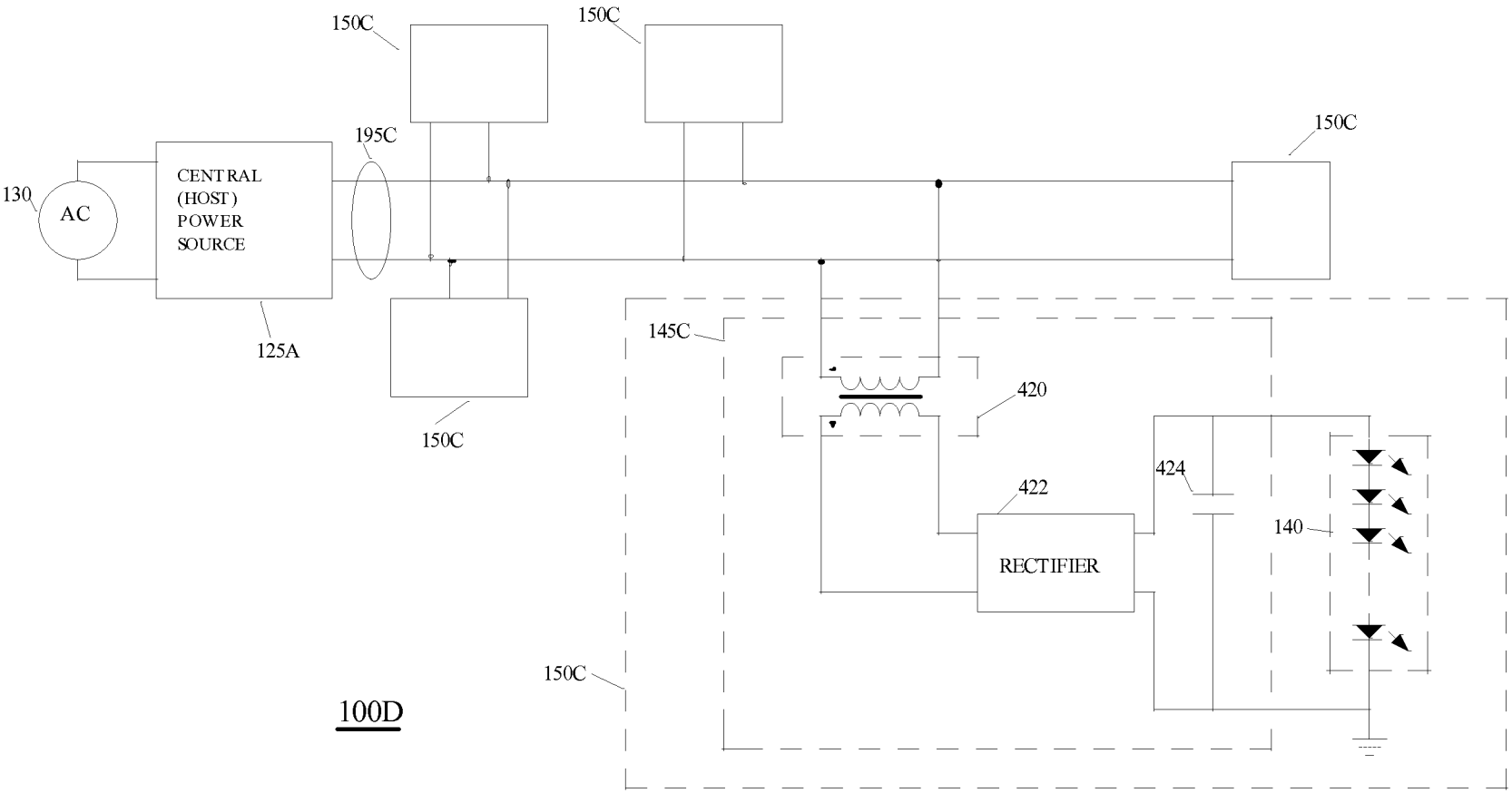
FIG. 8 is a block and circuit diagram illustrating a fourth exemplary or representative terminal LED lighting apparatus for use in a comparatively high frequency system.

FIG. 8 is a block and circuit diagram illustrating a fourth exemplary or representative terminal LED lighting apparatus 150C for use in a comparatively high frequency system 100D, which can be either a comparatively high or low voltage AC, and may have a wide range of suitable frequencies (e.g., about 500 Hz to 90 kHz), such as 60 kHz, for example and without limitation, indicated by designating the power transmission lines as high frequency lines 195C. As illustrated in FIG. 8, central (host) power source 125A is coupled to an AC input 130, and a plurality of terminal LED lighting apparatuses 150C are connected in parallel to the transmission lines 195C. Not separately illustrated, the central (host) power source 125A for this embodiment will generally also comprise a high frequency inverter to create the high frequency AC voltage on lines 195C. As illustrated, the current source (or regulator) 145C comprises a high frequency transformer 420, a rectifier 422 (e.g., a bridge rectifier), an optional filter capacitor 424, and may also include an additional current regulator (not separately illustrated) connected between the rectifier 422 and the capacitor 424. The optional filter capacitor 424 may be utilized to effectively remove any appreciable voltage ripple and provide flicker-free drive of the LEDs 140. An advantage of this topology is the comparatively small size of the current source (or regulator) 145C due to the small size of the high frequency transformer 420. Such a high frequency current source (or regulator) 145C may be implemented using a wide variety of topologies, currently known or developed in the future, such as those illustrated in FIGS. 9 and 10 discussed below.

Figure 9:
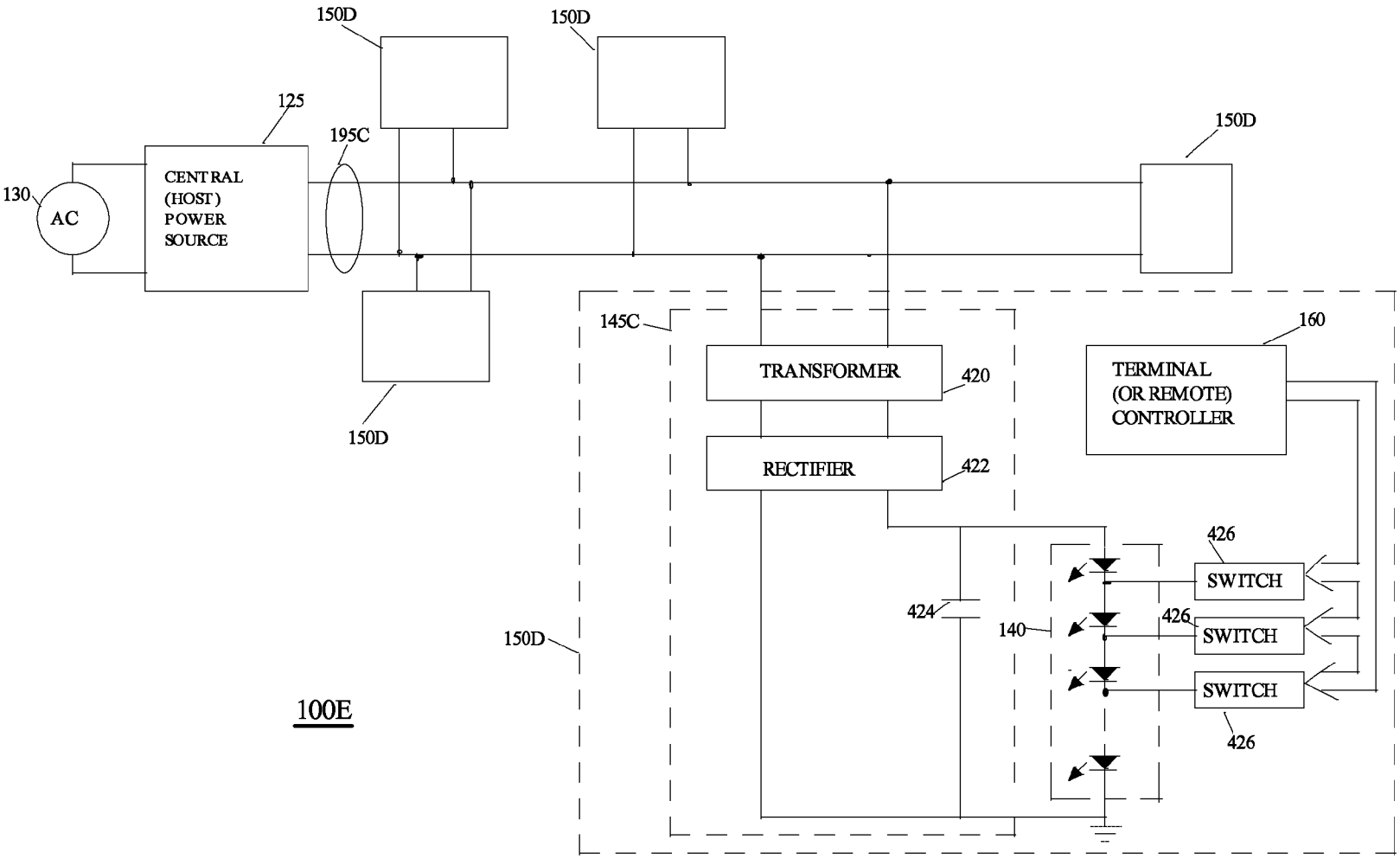
FIG. 9 is a block and circuit diagram illustrating a fifth exemplary or representative terminal LED lighting apparatus for use in a comparatively high frequency system.

FIG. 9 is a block and circuit diagram illustrating a fifth exemplary or representative terminal LED lighting apparatus 150D for use in a comparatively high frequency system 100E, which also can be either a comparatively high or low voltage AC, and may have a wide range of suitable frequencies (e.g., about 500 Hz to 90 kHz), such as 60 kHz, for example and without limitation, as discussed above. As illustrated in FIG. 9, central (host) power source 125A is coupled to an AC input 130, and a plurality of terminal LED lighting apparatuses 150D are connected in parallel to the transmission lines 195C. Also not separately illustrated, the central (host) power source 125A for this embodiment will generally also comprise a high frequency inverter to create the high frequency AC voltage on lines 195C. As illustrated, the current source (or regulator) 145C is also utilized, as discussed above. In this embodiment, which may be very effective at high frequency, a plurality of switches 426 are utilized to selectively bypass selected LEDs 140 of the illustrated plurality of series-connected LEDs 140. Initially, when the AC voltage is low (e.g., near a zero crossing), all of the switches are on and only a few or minimal number of LEDs 140 are connected in series to receive power (via rectifier 422 and transformer 420). As the instantaneous AC voltage increases, more LEDs 140 are switched into the series-connected path of LEDs 140, such as by sequentially turning off switches 426, and as the instantaneous AC voltage decreases, more LEDs 140 are switched out of the series-connected path of LEDs 140, such as by sequentially turning on switches 426. The optional filter capacitor 424 also may be utilized to effectively remove any appreciable voltage ripple and provide flicker-free drive of the LEDs 140.

Figure 10:
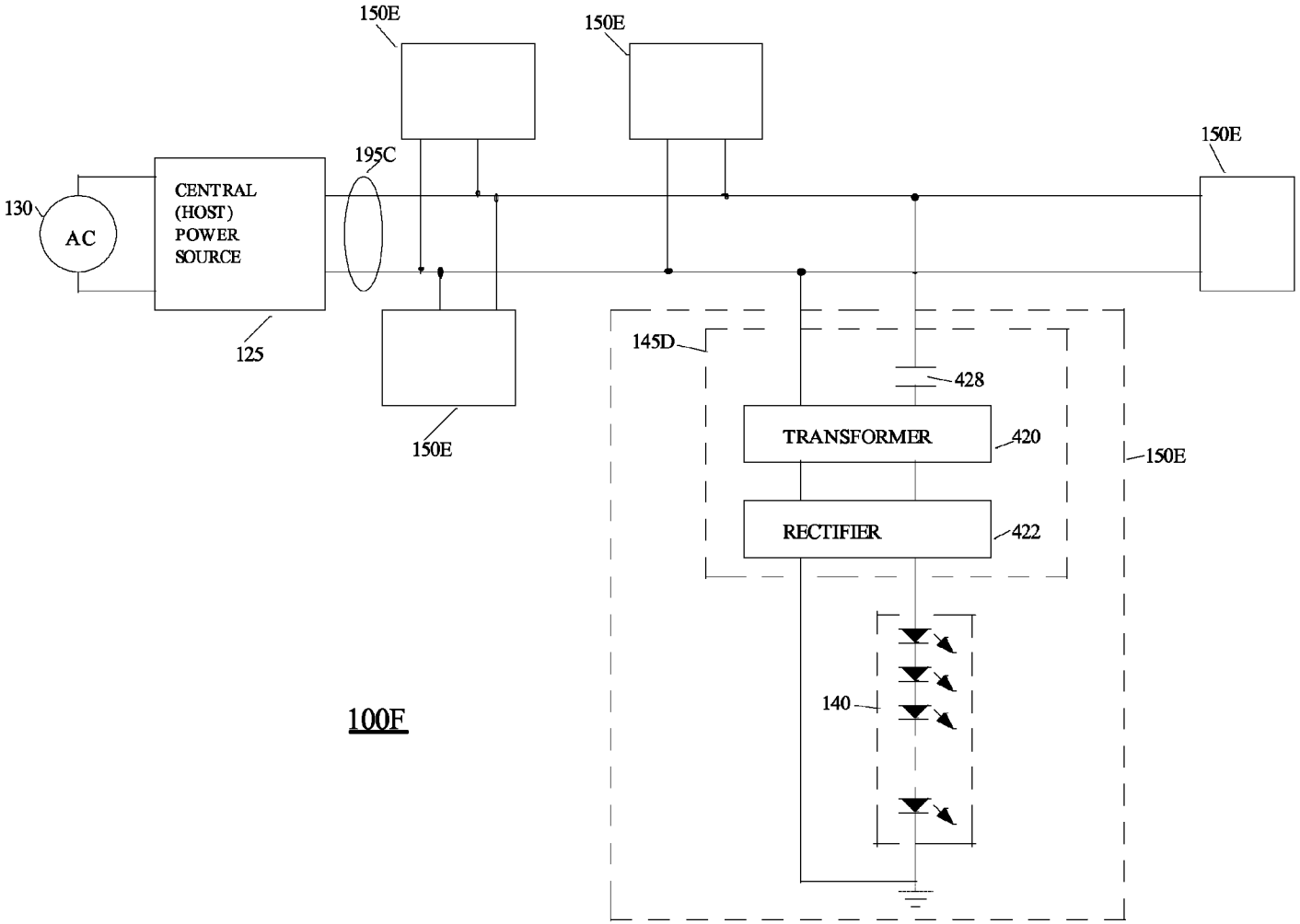
FIG. 10 is a block and circuit diagram illustrating a sixth exemplary or representative terminal LED lighting apparatus for use in a comparatively high frequency system.

FIG. 10 is a block and circuit diagram illustrating a sixth exemplary or representative terminal LED lighting apparatus 150E for use in a comparatively high frequency system 100F, which also can be either a comparatively high or low voltage AC, and may have a wide range of suitable frequencies (e.g., about 500 Hz to 90 kHz), such as 60 kHz, for example and without limitation, as discussed above. As illustrated in FIG. 10, central (host) power source 125A is coupled to an AC input 130, and a plurality of terminal LED lighting apparatuses 150E are connected in parallel to the transmission lines 195C. Not separately illustrated, the central (host) power source 125A for this embodiment also will generally also comprise a high frequency inverter to create the high frequency AC voltage on lines 195C. As illustrated, the current source (or regulator) 145D comprises a high frequency transformer 420, a rectifier 422 (e.g., a bridge rectifier), and a capacitor 428, which may be coupled on either the primary or the secondary side of the transformer 420. The capacitor 428 adds and additional impedance in series with the LEDs 140 and may be utilized to effectively improve their VA (Volt and Ampere) characteristics, providing a more stable current with voltage variation. The total impedance will be (Equation 12):

$$Z = \sqrt{X_c^2 + \frac{1}{K_t^4} R_{LED}^2},$$

where Xc is the impedance of the capacitor 428, Kt is the transformer ratio, and $R_{LED}$ is the equivalent LED 140 impedance.

Figure 11:
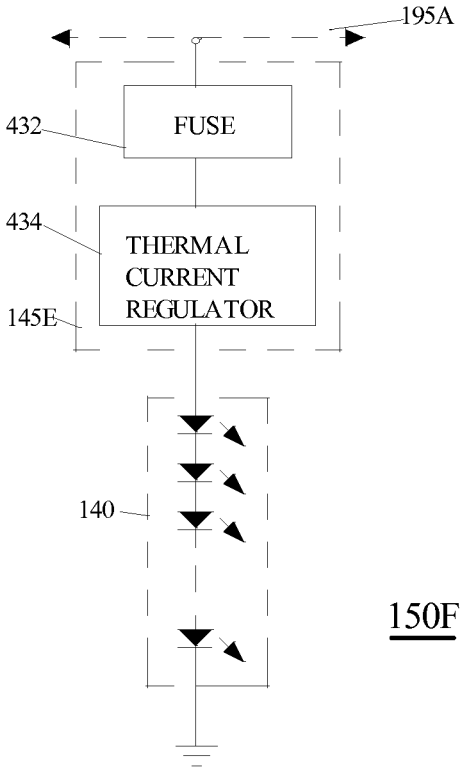
FIG. 11 is a block and circuit diagram illustrating a seventh exemplary or representative terminal LED lighting apparatus for a comparatively low voltage DC system.

FIG. 11 is a block and circuit diagram illustrating a seventh exemplary or representative terminal LED lighting apparatus 150F for a comparatively low voltage DC system 100A, such as illustrated in FIG. 5 and discussed above for other terminal LED lighting apparatuses 150A. An exemplary or representative terminal LED lighting apparatus 150F is coupleable to transmission power lines 195A, and comprises a plurality of LEDs 140 coupled in series to a current source (or regulator) 145E comprising very few components, namely, a fuse 432 and a thermal current regulator 434. For this comparatively simple terminal LED lighting apparatus 150F embodiment, the fuse 432 operates as known in the art to open circuit at or above a predetermined LED 140 current, while the thermal current regulator 434 will reduce the LED 140 current if the temperature of the terminal LED lighting apparatus 150F exceeds a predetermined threshold and thereby keep the LED 140 current within predetermined limits, and allowing use of the terminal LED lighting apparatus 150F with a central (host) power source 125 with an output voltage rout which may produce a wide range of LED 140 currents. As discussed above, as an option, such an embodiment may also include in its housing, labeling and/or packaging, machine-readable encoded fields 170 which may be scanned into the central (host) power source 125 during set up or during exchange modes, which will typically include encoded information for minimum and maximum voltage and minimum and maximum current for the terminal LED lighting apparatuses 150F, and possibly a network address for the apparatus 150F. As mentioned above, these maximum and minimum voltage and current parameters may also be provided on the basis of minimum and maximum LED 140 voltage levels, minimum and maximum LED 140 current, for the incorporated string of LEDs 140. These operational parameters may also be manually entered, as discussed above. For example, for this embodiment, minimum input voltage and minimum input current levels for the terminal LED lighting apparatus 150F are typically entered and stored in the central (host) power source 125.

A plurality of terminal LED lighting apparatuses 150F may be utilized in a system 100A up to the power capacity of the central (host) power source 125, with operational parameters input into the system 100A during set up and/or exchange modes as previously discussed. During operation (automatic mode), the central (host) power source 125 is turned on and provides a minimum output voltage Vout, and then typically progressively ramps up the output voltage Vout, typically below or up to a maximum Vout that is based on the minimum and maximum voltage and current parameters for the plurality of terminal LED lighting apparatuses 150F, so that at least minimum voltage and current are provided to the terminal LED lighting apparatuses 150F and the maximum voltage and current of the terminal LED lighting apparatuses 150F generally are not exceeded, as discussed above. For example, in an exemplary embodiment, during operation (automatic mode), Vout=Vinmin for the terminal LED lighting apparatuses 150F. Also or example, a Vout may be determined by the central (host) controller 120 to be based upon an output voltage that would be required to provide an output current which is greater than, by a selected percentage, the sum of the minimum LED 140 currents for all of the terminal LED lighting apparatus 150F included within the system 100A, such as Vout=$\tau$1.1$\Sigma$ minimum $I_{LED}$ (where $\tau$ is a transfer function or other conversion factor), or setting Voutmax=the minimum $V_{LED}$, or setting the output current of the central (host) power source 125=1.1$\Sigma$ minimum $I_{LED}$, or based upon a range in between minimum and maximum voltage and current levels of the terminal LED lighting apparatuses 150F, such as maximum $V_{LED}$≥Vout≥minimum $V_{LED}$, or 1.1$\Sigma$ minimum $I_{LED}$≤output current of the central (host) power source 125≤0.8$\Sigma$ maximum $I_{LED}$, etc., for example and without limitation. For this embodiment, the output current and voltage of the central (host) power source 125 also is typically monitored, with feedback provided as discussed above, so that these current and voltage levels are within an acceptable margin and do not exceed the current and voltage limits discussed above for the plurality of terminal LED lighting apparatuses 150F.

Figure 12:
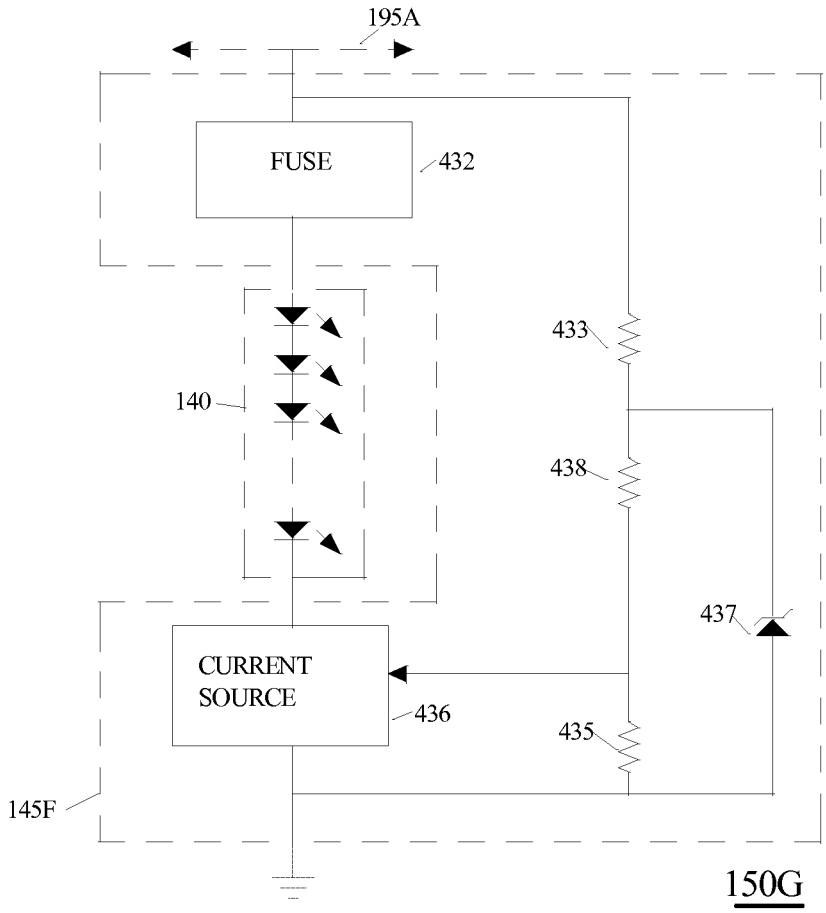
FIG. 12 is a block and circuit diagram illustrating an eighth exemplary or representative terminal LED lighting apparatus for a comparatively low voltage DC system.

FIG. 12 is a block and circuit diagram illustrating an eighth exemplary or representative terminal LED lighting apparatus 150G for a comparatively low voltage DC system 100A, such as illustrated in FIG. 5 and discussed above for other terminal LED lighting apparatuses 150A and 150F. An exemplary or representative terminal LED lighting apparatus 150G is coupleable to transmission power lines 195A, and comprises a plurality of LEDs 140 coupled to a current source (or regulator) 145F. For this representative embodiment, the current source (or regulator) 145F comprises a fuse 432, a current source 436 which is controlled by a voltage provided by a voltage divider comprising a plurality of resistors 433, 438, and 435, and zener diode 437. For this moderately complicated terminal LED lighting apparatus 150G embodiment, the fuse 432 also operates as known in the art to open circuit at or above a predetermined LED 140 current, while the control voltage provided to the current source 436 by the voltage divider components is typically stably fixed by the resistors 435, 438 and zener diode 437, with the current source 436 providing a comparatively constant LED 140 current limit. Also as discussed above, as an option, such an embodiment may also include in its housing, labeling and/or packaging, machine-readable encoded fields 170 which may be scanned into the central (host) power source 125 during set up or during exchange modes, which will typically include encoded information for minimum and maximum voltage and minimum and maximum current for the terminal LED lighting apparatuses 150G, and possibly a network address for the apparatus 150G. As mentioned above, these maximum and minimum voltage and current parameters may also be provided on the basis of minimum and maximum LED 140 voltage levels, and minimum and maximum LED 140 current levels, for the incorporated string of LEDs 140. These operational parameters may also be manually entered, as discussed above. For example, for this embodiment, minimum input voltage and minimum input current levels for the terminal LED lighting apparatus 150G are typically entered and stored in the central (host) power source 125.

A plurality of terminal LED lighting apparatuses 150G may be utilized in a system 100A up to the power capacity of the central (host) power source 125, with operational parameters input into the system 100A during set up and/or exchange modes as previously discussed. During operation (automatic mode), the central (host) power source 125 is turned on and provides the selected output voltage Vout, typically at (or below) a maximum Vout that is based on the minimum and maximum voltage and current parameters of the terminal LED lighting apparatuses 150G, so that at least minimum voltage and current is provided to the terminal LED lighting apparatuses 150G and the maximum voltage and current of the terminal LED lighting apparatuses 150G generally is not exceeded, also as discussed above. For example, in an exemplary embodiment, during operation (automatic mode), Voutmax=Vinmin for the terminal LED lighting apparatuses 150G. Also for example, a Vout may be determined by the central (host) controller 120 to be based upon a selected percentage above the sum of the minimum LED 140 currents for all of the terminal LED lighting apparatus 150G included within the system 100A, such as Vout$\propto$1.1$\Sigma$ minimum $I_{LED}$, or setting Voutmax=the minimum $V_{LED}$, or setting the output current of the central (host) power source 125=1.1$\Sigma$ minimum $I_{LED}$, or based upon a range in between minimum and maximum voltage and current levels of the terminal LED lighting apparatuses 150G, such as maximum $V_{LED} \geq V_{out} \geq$minimum $V_{LED}$, or 1.1$\Sigma$ minimum $I_{LED} \leq$output current of the central (host) power source 125$\leq$0.8$\Sigma$ maximum $I_{LED}$, etc., for example and without limitation. For this embodiment, the output current and voltage of the central (host) power source 125 also is typically monitored, with feedback provided as discussed above, so that these current and voltage levels are within an acceptable margin and do not exceed the current and voltage limits discussed above for the plurality of terminal LED lighting apparatuses 150G.

For example, in an exemplary embodiment, during operation (automatic mode), Voutmax=Vinmin for the terminal LED lighting apparatuses 150G, and the output current of the central (host) power source 125 is monitored such that the output current $\leq$1.1$\Sigma$ minimum $I_{LED}$.

Figure 13:
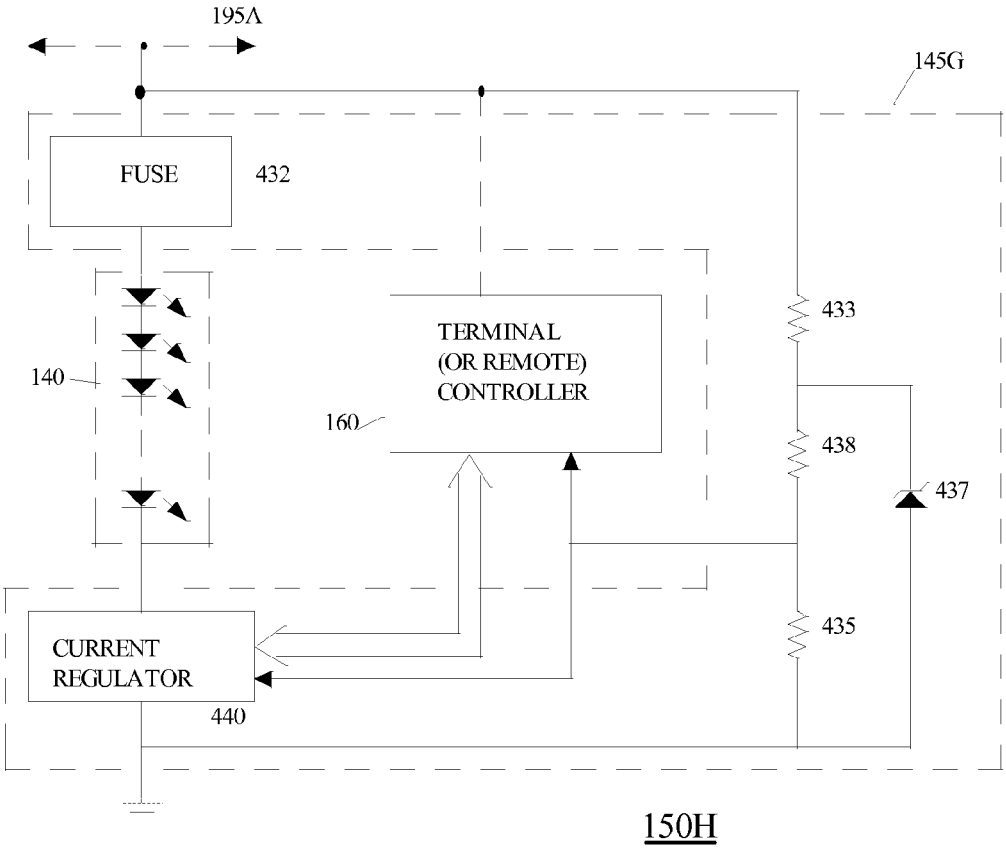
FIG. 13 is a block and circuit diagram illustrating a ninth exemplary or representative terminal LED lighting apparatus for a comparatively low voltage DC system.

FIG. 13 is a block and circuit diagram illustrating a ninth exemplary or representative terminal LED lighting apparatus 150H for a comparatively low voltage DC system 100A, such as illustrated in FIG. 5 and discussed above for other terminal LED lighting apparatuses 150A, 150F, and 150G. An exemplary or representative terminal LED lighting apparatus 150H is coupleable to transmission power lines 195A, and comprises a terminal (or remote) controller 160, and a plurality of LEDs 140 coupled to a current source (or regulator) 145G. For this representative embodiment, the current source (or regulator) 145G comprises a fuse 432, a current regulator 440, and a voltage divider comprising a plurality of resistors 433, 438, and 435, and zener diode 437, which is utilized to provide operating voltages for the terminal (or remote) controller 160 and the current regulator 440. The current regulator 440, for example, may be implemented as a buck converter or a flyback converter, or any other converter or current regulator topology, and may typically comprise an inductor, a MOSFET, a sense resistor, and a diode (as previously illustrated and previously discussed with reference to FIG. 5), for example and without limitation. For this terminal LED lighting apparatus 150H embodiment, the fuse 432 also operates as known in the art to open circuit at or above a predetermined LED 140 current, while the operational voltage provided to the current source 436 by the voltage divider components is typically stably fixed by the resistors 435, 438 and zener diode 437. The LED 140 current, however, is typically determined by control signals provided to the current regulator 440 by the terminal (or remote) controller 160, based upon a sensed or measured value of Vin, as discussed above, such as with reference to FIG. 3, based upon the value of Vout provided by the central (host) power source 125 for a selected dimming level "ρ". Also as discussed above, as an option, such an embodiment may also include in its housing, labeling and/or packaging, machine-readable encoded fields 170 which may be scanned into the central (host) power source 125 during set up or during exchange modes, which will typically include encoded information for minimum and maximum voltage and minimum and maximum current for the terminal LED lighting apparatuses 150H, and possibly a network address for the apparatus 150H. As mentioned above, these maximum and minimum voltage and current parameters may also be provided on the basis of minimum and maximum LED 140 voltage levels, and minimum and maximum LED 140 current levels, for the incorporated string of LEDs 140. These operational parameters may also be manually entered, as discussed above.

A plurality of terminal LED lighting apparatuses 150H may be utilized in a system 100A up to the power capacity of the central (host) power source 125, with operational parameters input into the system 100A during set up and/or exchange modes as previously discussed. For example, during set up or exchange modes for a first embodiment, minimum and maximum input voltage and minimum and maximum input current levels for the terminal LED lighting apparatus 150H are typically entered and stored in the central (host) power source 125. For example, during set up or exchange modes for a second embodiment, maximum input voltage and minimum (and optionally) maximum input current levels for the terminal LED lighting apparatus 150H are typically entered and stored in the central (host) power source 125. For either or both embodiments, the central (host) controller 120 then sets Voutmax=Vinmax for the terminal LED lighting apparatuses 150H, without manual override, and sets a limit for output current from the central (host) power source 125 equal to 1.1$\Sigma$ minimum $I_{LED}$ for the terminal LED lighting apparatuses 150H.

During operation (automatic mode), the central (host) power source 125 is turned on and provides the selected output voltage Vout, typically at (or below) the maximum Voutmax that is based on the maximum voltage parameter of the terminal LED lighting apparatuses 150H. For example, when turned on, the central (host) power source 125 may automatically provide Voutmax, for maximum brightness, or may provide a lower Vout corresponding to its last dimming setting by the user. Concurrently, the central (host) controller 120 monitors output current from the central (host) power source 125 and provides corresponding feedback signals to maintain output current $\leq$1.1$\Sigma$ minimum $I_{LED}$, for example, so that the output current levels are within an acceptable margin and do not exceed the current limits discussed above for the plurality of terminal LED lighting apparatuses 150H. Similarly for this embodiment, in addition to monitoring output current, the output voltage Vout of the central (host) power source 125 also is typically monitored, with feedback provided as discussed above, so that the selected dimming level is provided and further, that the output voltage levels are within an acceptable margin and do not exceed the voltage limits discussed above for the plurality of terminal LED lighting apparatuses 150H.

Figure 14:
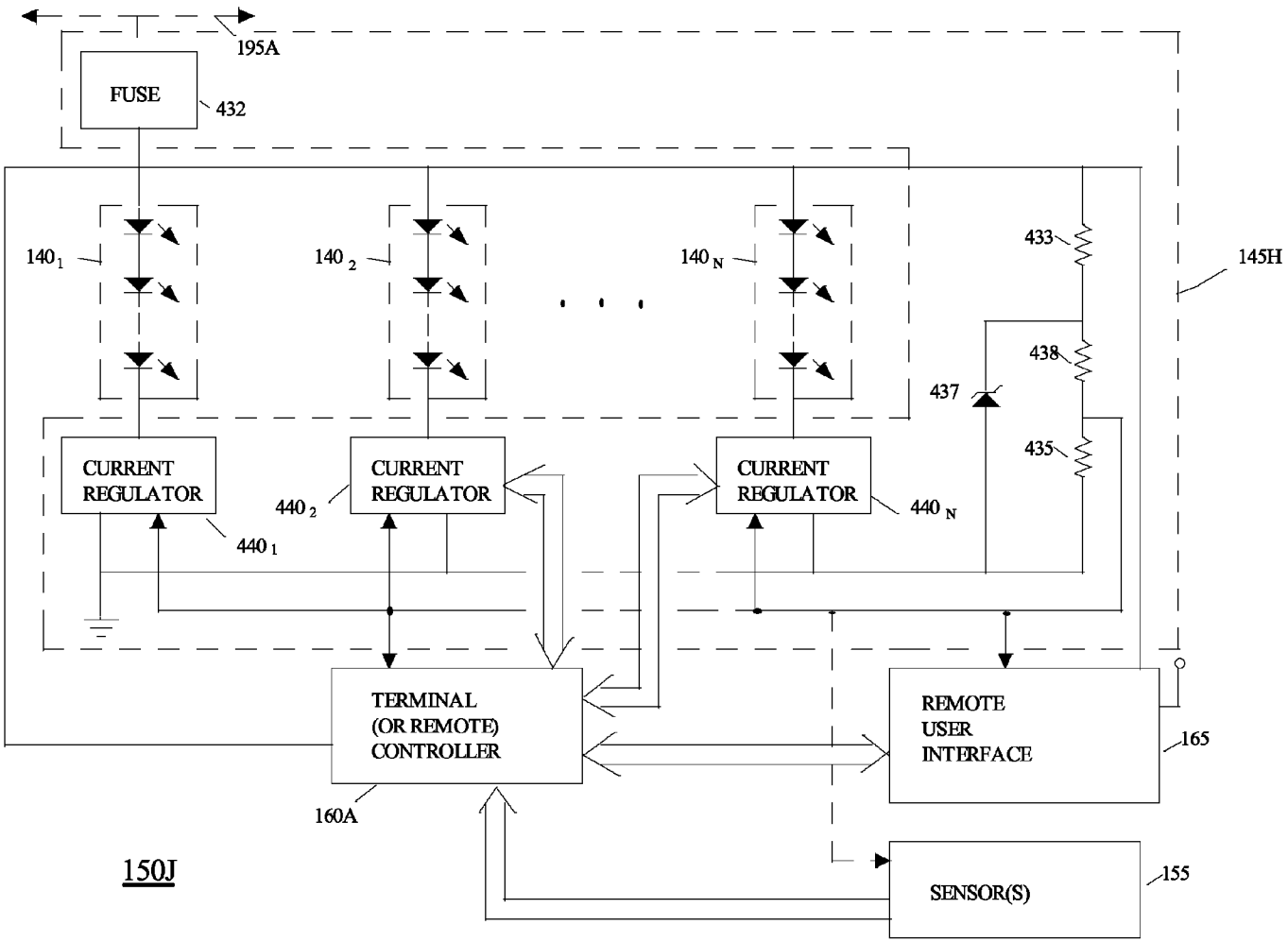
FIG. 14 is a block and circuit diagram illustrating a tenth exemplary or representative terminal LED lighting apparatus for a comparatively low voltage DC system.

FIG. 14 is a block and circuit diagram illustrating a tenth exemplary or representative terminal LED lighting apparatus 150J for a comparatively low voltage DC system 100A, such as illustrated in FIG. 5 and discussed above for other terminal LED lighting apparatuses 150A, 150F, 150G, and 150H. In this exemplary embodiment, the terminal LED lighting apparatus 150J functions similarly to terminal LED lighting apparatus 150H, but now includes multiple series-connected (strings) or channels of LEDs 140, illustrated as channel one LEDs $\mathbf{140}_1$, channel two LEDs $\mathbf{140}_2$, through channel "N" LEDs $\mathbf{140}_N$, each of which is controlled by a corresponding current regulator 440, illustrated respectively as current regulator $\mathbf{440}_1$, current regulator $\mathbf{440}_2$, through current regulator $\mathbf{440}_N$. Each of the LED 140 channels may provide a different color, color temperature, or other lighting effect, for example and without limitation, such as channel one comprising red LEDs $\mathbf{140}_1$, channel two comprising green LEDs $\mathbf{140}_2$, through channel "N" comprising blue LEDs $\mathbf{140}_N$, etc. There may be any number of LED 140 channels. In turn, each of the various current regulators 440 are separately (and/or independently) controlled by a terminal (or remote) controller 160A, which has expanded capability to independently control each channel, rather than controlling the current through a single string of LEDs through a single current regulator 440. In addition, the terminal LED lighting apparatus 150J optionally includes a remote user interface 165 and one or more sensors 155 (which, for example, may be implemented as current sense resistors (e.g., 402) within each current regulator 440, or which may provide additional sensing capabilities).

An exemplary or representative terminal LED lighting apparatus 150J also is coupleable to transmission power lines 195A, and comprises a terminal (or remote) controller 160A, and a plurality of strings of LEDs 140 which are coupled to a current source (or regulator) 145H. For this representative embodiment, the current source (or regulator) 145H comprises a fuse 432, a plurality of current regulators 440, and a voltage divider comprising a plurality of resistors 433, 438, and 435, and zener diode 437, which is utilized to provide operating voltages for the terminal (or remote) controller 160A, the current regulators 440, the optional remote user interface 165, and the sensor(s) 155 (depending upon the type of sensor(s) 155 utilized). The current regulators 440, for example, may be implemented as a buck converter or a flyback converter, or any other converter or current regulator topology, and may typically comprise an inductor, a MOSFET, a sense resistor, and a diode (as previously illustrated and previously discussed with reference to FIG. 5), for example and without limitation. For this terminal LED lighting apparatus 150J embodiment, the fuse 432 also operates as known in the art to open circuit at or above a predetermined LED 140 current, while the operational voltage provided to the current source 436 by the voltage divider components is typically stably fixed by the resistors 435, 438 and zener diode 437.

The currents of the various LED 140 channels, however, are separately (and/or independently) determined by control signals provided to the respective current regulators 440 by the terminal (or remote) controller 160. In one exemplary embodiment, the terminal (or remote) controller 160A may determine each such LED 140 current based upon a sensed or measured value of Vin, as discussed above, such as with reference to FIG. 3, based upon the value of Vout provided by the central (host) power source 125 for a selected dimming level "ρ". In another exemplary embodiment, the terminal (or remote) controller 160A may determine each such LED 140 current separately (and/or independently), not only based upon a sensed or measured value of Vin, but also based upon color mixing and color temperature control, for any selected lighting effect, and separate dimming for each LED 140 channel, such as provided through the remote user interface 165 for user control, or through sensor(s) 155 (which may override or supplement the remote control by the user), or as potentially communicated by the central (host) controller 120, also separately (and/or independently) for each LED 140 channel, such as through additional wiring, wireless communication, or power line signaling as mentioned above.

Also as discussed above, as an option, such an embodiment may also include in its housing, labeling and/or packaging, machine-readable encoded fields 170 which may be scanned into the central (host) power source 125 during set up or during exchange modes, which will typically include, for each LED 140 channel of each terminal LED lighting apparatus 150J, encoded information for minimum and maximum voltage and minimum and maximum current, and possibly a network address for the apparatus 150J. As mentioned above, these maximum and minimum voltage and current parameters may also be provided on the basis of minimum and maximum LED 140 voltage levels, and minimum and maximum LED 140 current levels, for each of the incorporated channels of LEDs 140. These operational parameters may also be manually entered, as discussed above.

A plurality of terminal LED lighting apparatuses 150J may be utilized in a system 100A up to the power capacity of the central (host) power source 125, with operational parameters input into the system 100A during set up and/or exchange modes as previously discussed. For example, during set up or exchange modes for a first embodiment, minimum and maximum input voltage and minimum and maximum input current levels for the terminal LED lighting apparatus 150J are typically entered and stored in the central (host) power source 125. For example, during set up or exchange modes for a second embodiment, maximum input voltage and minimum (and optionally) maximum input current levels for the terminal LED lighting apparatus 150J are typically entered and stored in the central (host) power source 125. For either or both embodiments, the central (host) controller 120 then sets Voutmax=Vinmax for the terminal LED lighting apparatuses 150H, without manual override, and sets a limit for output current from the central (host) power source 125 equal to 1.1Σ minimum $I_{LED}$ for the terminal LED lighting apparatuses 150J.

During operation (automatic mode), the central (host) power source 125 is turned on and provides the selected output voltage Vout, typically at (or below) the maximum Voutmax that is based on the maximum voltage parameter of the terminal LED lighting apparatuses 150J. For example, when turned on, the central (host) power source 125 may automatically provide Voutmax, for maximum brightness, or may provide a lower Vout corresponding to its last dimming setting by the user. Concurrently, the central (host) controller 120 monitors output current from the central (host) power source 125 and provides corresponding feedback signals to maintain output current ≤1.1Σ minimum $I_{LED}$, for example, so that the output current levels are within an acceptable margin and do not exceed the current limits discussed above for the plurality of terminal LED lighting apparatuses 150J. Similarly for this embodiment, in addition to monitoring output current, the output voltage Vout of the central (host) power source 125 also is typically monitored, with feedback provided as discussed above, so that the selected dimming level is provided and further, that the output voltage levels are within an acceptable margin and do not exceed the voltage limits discussed above for the plurality of terminal LED lighting apparatuses 150J.

In addition, using one or more terminal LED lighting apparatuses 150J, via central or remote user interfaces 135, 165, a user may select any of a wide range of lighting effects and a wide variety of brightness levels, such as color mixing, color temperature, and various architectural lighting effects, any and all of which may also include different levels of dimming.

Figure 15:
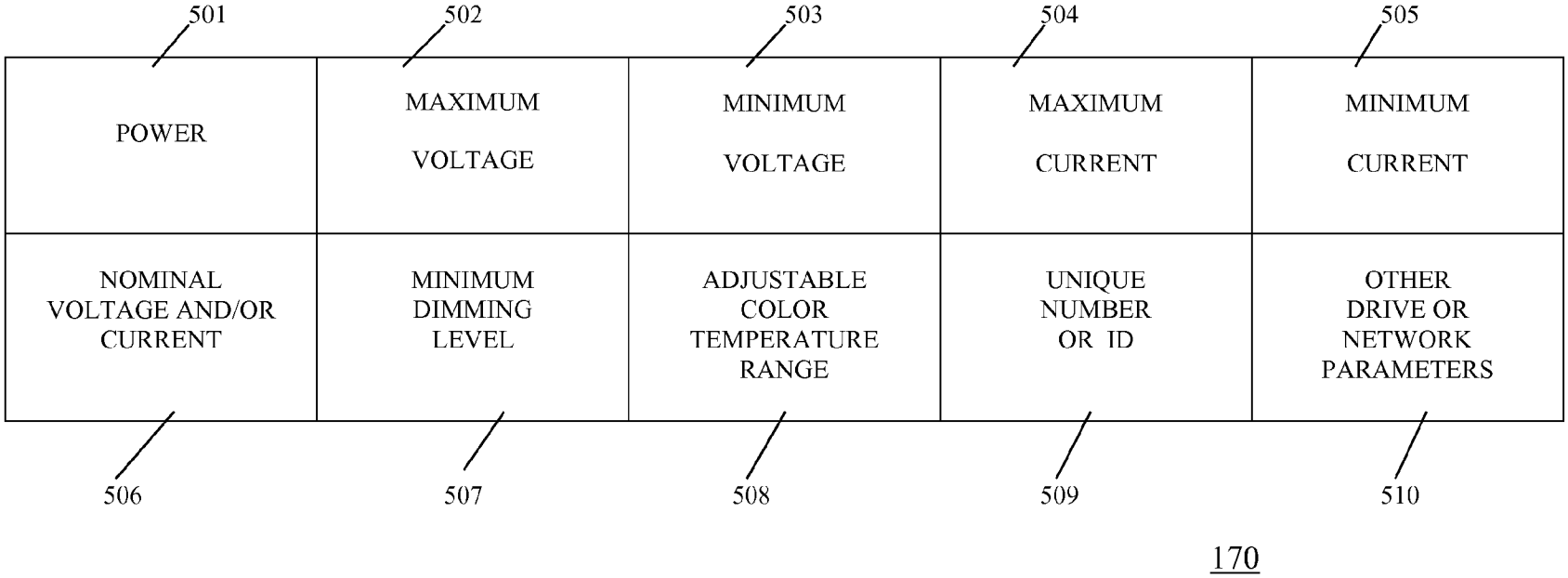
FIG. 15 is a diagram illustrating exemplary or representative machine-readable encoded fields, such as barcode fields or QR code fields, for use with an exemplary or representative apparatus, method and system.

FIG. 15 is a diagram illustrating exemplary or representative machine-readable encoded fields 170, such as barcode fields or QR code fields, for use with an exemplary or representative apparatus, method and system. The machine-readable encoded fields 170 may have any selected, suitable or appropriate format, known or developed in the future, such as the vertical lines, bars and spaces of a linear or matrix UPC barcode, or the various QR encoded fields. As illustrated in FIG. 15, exemplary machine-readable encoded fields 170 comprises a plurality of fields 501-510, not all of which are required to be used, and many of which may be optional, including one or more power fields, such as maximum or nominal power rating field 501; one or more voltage fields, such as maximum voltage field 502 and minimum voltage field 503; one or more current fields, such as maximum current field 504 and minimum current field 505; a nominal voltage/current field 506, specifying the LED 140 voltage at nominal current; a minimum dimming level (voltage or current) field 507; an adjustable color temperature range field 508; a unique number or identification (I.D.) field 509 for the particular terminal LED lighting apparatus 150; and a field 510 for any other drive or network parameters. Not separately illustrated in FIG. 15 may be fields for format information, error correction, manufacturer, model number, etc.

As mentioned above, this data input (e.g., scanned) from machine-readable encoded fields 170 will be stored in the controller 120 memory and used for technical purposes to program the central (host) controller 120 as described above. Another application of this information is suggested and may be used for generating lighting reports for the user, with performance metrics over time, and as an example and without limitation, may include any of the various following information, such as: number of terminal LED lighting apparatuses 150 installed and dates of installation; number of terminal LED lighting apparatuses 150 which failed; a listing of failed terminal LED lighting apparatuses 150 with total hours of performance; average annual or daily consumed power, annual, daily, etc.; average daily on time; and average daily dimming level.

In one exemplary or representative embodiment, a user is provided with a retrofitting kit, as mentioned above. Such a retrofitting kit may include a central (host) power source 125, with or without a dimmer function, having a form factor suitable for replacing a standard lighting or dimmer switch as described above, and one or more terminal LED lighting apparatuses 150 (as LED bulbs) designed to operate in conjunction with the central (host) power source 125. A user wishing to retrofit a lighting system would be able to easily replace a legacy wall switch with the central (host) power source 125 having a legacy-compatible form factor provided in the retrofitting kit, connecting it properly to the electrical supply line and to the feed lines to the lighting load(s). The terminal LED lighting apparatuses 150 (as LED bulbs) can then be installed in place of the original incandescent of CFL bulbs used as terminators on the feed lines connected to the retrofitted central (host) power source 125.

In another exemplary embodiment, the retrofitting kit may also include one or more lighting sockets (not separately illustrated) which each have a mating form factor or interface, designed or adapted to fit the form factor or interface of the one or more terminal LED lighting apparatuses 150. A user wishing to retrofit a lighting system would be able to easily replace existing, legacy lighting sockets with the new sockets having the new mating or otherwise compatible form factor provided in the retrofitting kit, connecting it properly to the feed lines from the central (host) power source 125 (and to any existing ground or neutral).

Figure 16:
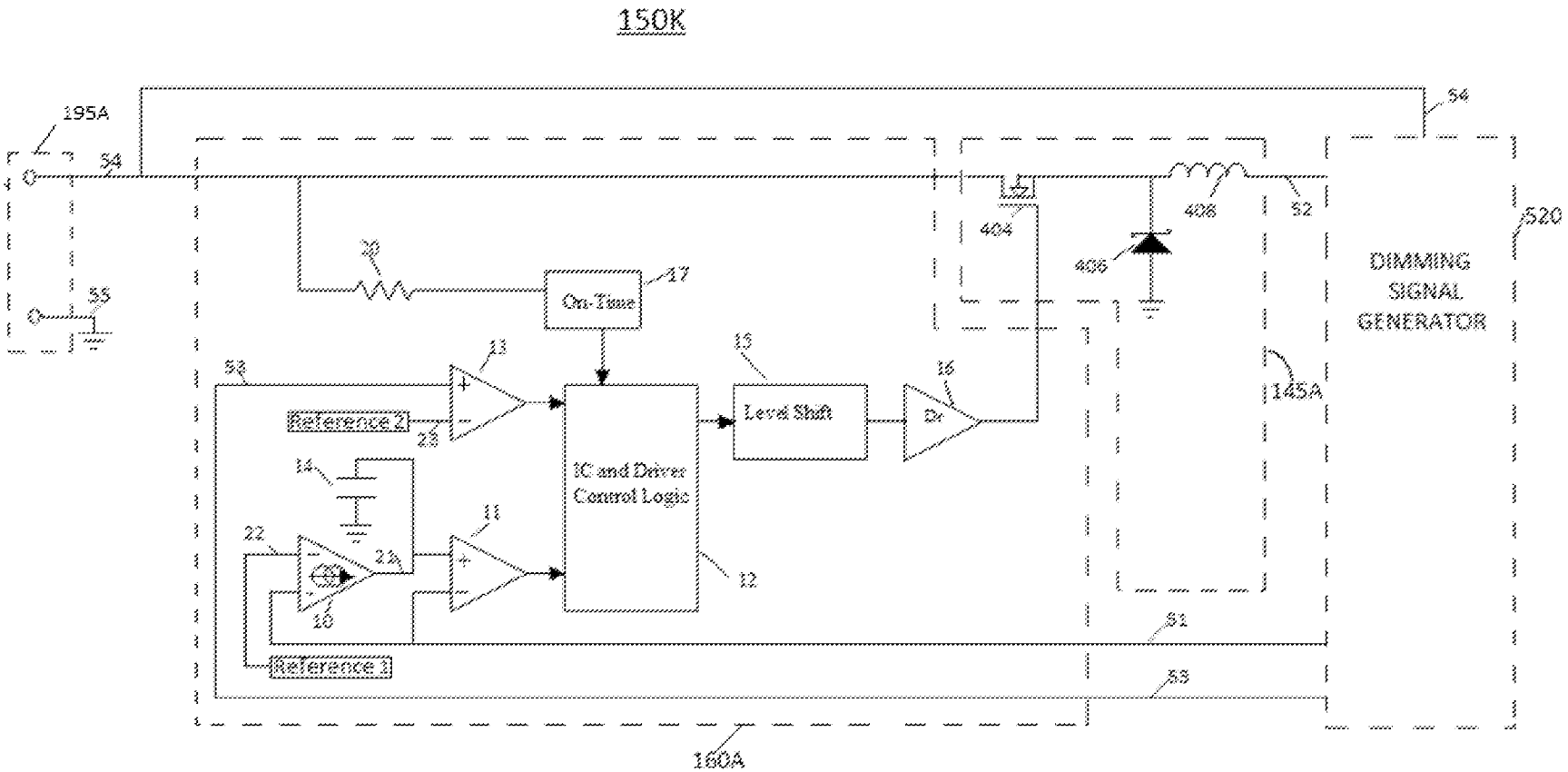
FIG. 16 is a block and circuit diagram illustrating an eleventh exemplary or representative terminal LED lighting apparatus for use in a comparatively low voltage DC system with an exemplary or representative first terminal or remote controller and an exemplary or representative dimming signal generator.
Figure 17:
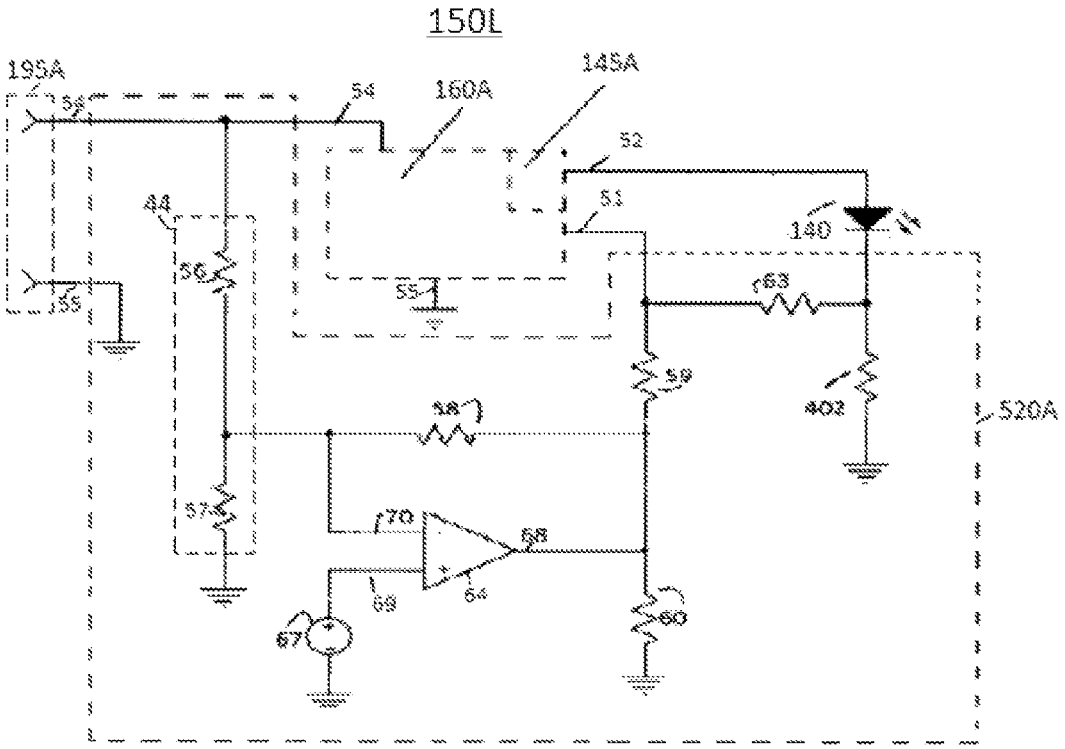
FIG. 17 is a block and circuit diagram illustrating an exemplary or representative first dimming signal generator implemented using analog control.
Figure 18:
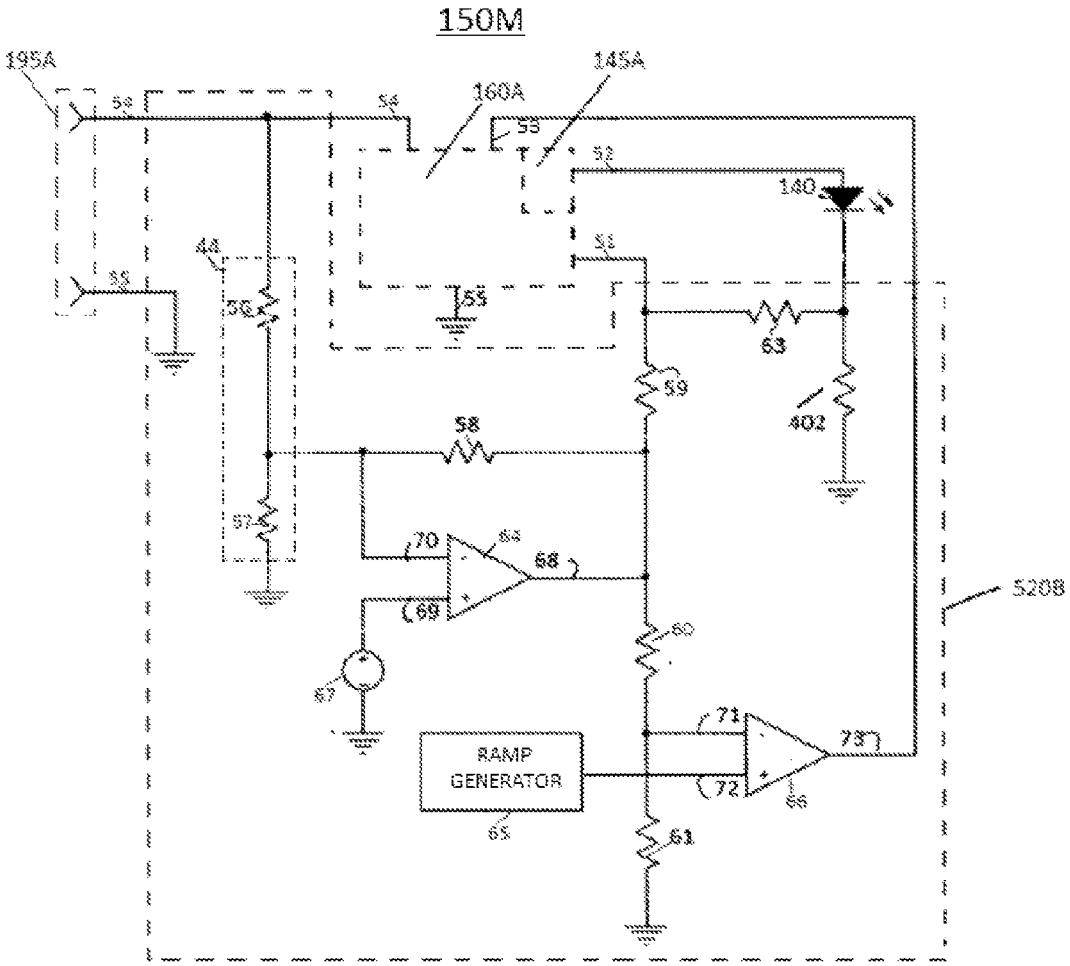
FIG. 18 is a block and circuit diagram illustrating an exemplary or representative second dimming signal generator, implementing combined analog and PWM control.

FIG. 16 is a block and circuit diagram illustrating an eleventh exemplary or representative terminal LED lighting apparatus 150K for use in a comparatively low voltage DC system with an exemplary or representative first terminal or remote controller 160A and an exemplary or representative dimming signal generator 520. FIG. 17 is a block and circuit diagram illustrating an exemplary or representative first dimming signal generator 520A implemented using analog control, in an exemplary or representative terminal LED lighting apparatus 150L. FIG. 18 is a block and circuit diagram illustrating an exemplary or representative second dimming signal generator 520B, implementing combined analog and PWM control, in an exemplary or representative terminal LED lighting apparatus 150M. LEDs 140 are not separately illustrated in FIG. 16.

Such an exemplary or representative embodiment provides a terminal LED lighting apparatus 150K with dimming capability for DC luminaires, lamps or bulbs. Such an exemplary or representative terminal LED lighting apparatus 150K is illustrated as comprising an exemplary or representative first terminal or remote controller 160A, an exemplary or representative dimming signal generator 520, and a current source (or regulator) 145A with a buck topology comprised of inductor 408, diode 406, and MOSFET 404, using a current sense resistor 402 (illustrated in FIGS. 17 and 18) as a feedback to the first terminal or remote controller 160A. The series-connected string of LEDs 140 (illustrated in FIGS. 17 and 18) is driven by a current regulated source, and the LEDs 140 do not require binning during manufacturing. While a buck converter is illustrated, any other type of converter may be utilized equivalently, including buck-boost, sepic, flyback, and many others currently known or developed in the future.

As illustrated in FIG. 16, an exemplary or representative first terminal or remote controller 160A may be implemented as known in the electronic arts and industry, and is illustrated for purposes of example and without limitation, and typically may comprise a frequency set resistor 20, on-time generator 17, input for analog dimming 51, current sense comparators 10 and 11 with reference voltage 22, PWM comparator 13 with reference voltage 23, control logic 12, level shift 15, high side switch driver 16, filter capacitor 14. For example, an exemplary or representative first terminal or remote controller 160A may be implemented as a Texas Instruments LM3404 integrated circuit. Low voltage DC lines 195A are illustrated as lines 54 and 55 (which are also coupled to dimming signal generator) 520).

The dimming signal generator 520 is utilized to control such a first terminal or remote controller 160A when implemented as such an off-the-shelf component, typically having limited capabilities, such as to enable sophisticated dimming capability in the exemplary DC system. For example, a voltage change on the low voltage DC lines 195A (such as from 56V to 48V, or from 47V to 40V, as examples of any of a wide variety of DC voltage ranges which may be utilized equivalently) using the dimming signal generator 520, will generate a change in LED 140 current (100% to 0%) resulting in dimming corresponding to full brightness light output to zero light output. Stated another way, the dimming signal generator 520 will "spoof" or fool the first terminal or remote controller 160A, by interfering with or modulating feedback signals to the first terminal or remote controller 160A, and by doing so, will provide significant dimming capability.

Referring to FIG. 17, the first dimming signal generator 520A comprises an operational amplifier 64 with a reference voltage 67, feedback resistor 58, and one or more voltage dividers, such as a first voltage divider 44 implemented using resistors 56 and 57, and a second voltage divider implemented using resistors 59 and 60. Current to the LEDs 140 is provided on line 52 from current source (or regulator) 145A. Current sense feedback (to line, node or input 51 of the first terminal or remote controller 160A) of LED 140 current is provided via current sense resistor 402 and resistor 63.

Figure 19:
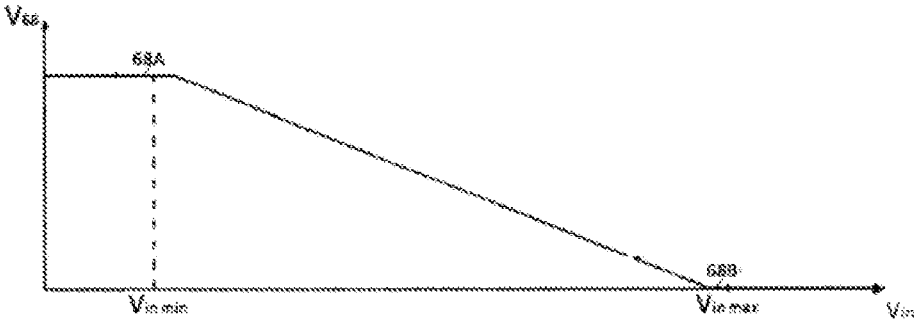
FIG. 19 is a graphical diagram illustrating an output control voltage signal as a function of input voltage.

As mentioned above, a user may control light output in a system 100, resulting in a change in DC voltage levels on lines 195A, between a maximum DC voltage level ("Vinmax") and a minimum DC voltage level ("Vinmin") on line 54. This change in DC voltage may be sensed using resistors 56 and 57 (as a first voltage divider 44), and provided on input 70 to operational amplifier 64, which compares this voltage to reference voltage 67 input on line 69. As the voltage drops across first voltage divider 44 (in comparison to reference voltage 67), the operational amplifier 64 generates a greater output voltage ($V_{68}$) on line 68, as illustrated in FIG. 19. In addition to increasing the current through resistor 60, this greater output voltage from the operational amplifier 64 on line 68 also results in increased current through a current path comprising resistors 59, 63 and 402, changing the voltage (and/or current) being sensed on current sense resistor 402 via (current) feedback input 51 of the first terminal or remote controller 160A (i.e., increases the voltage at input or node 51). As a result, the current feedback to the first terminal or remote controller 160A (falsely) indicates a greater LED 140 current than actually exists, and in response, the first terminal or remote controller 160A, controlling the current source (or regulator) 145A, lowers the current level provided to the LEDs 140 (on line 52), resulting in the desired dimming of light output. Conversely, when the DC voltage levels on lines 195A increases (to increase output brightness), the output voltage from the operational amplifier 64 on line 68 will become lower, decreasing the voltage (and/or current) level at input (or node) 51, making it appear that the LED 140 current has decreased, and in response, the first terminal or remote controller 160A, controlling the current source (or regulator) 145A, raises the current level provided to the LEDs 140 (on line 52), resulting in the desired brightness of light output.

Stated another way, this depth of dimming (for example 1:1000) is executed by changing the input voltage Vin on lines 195A from Vinmin to Vinmax (for example, 40V to 47V), by controlling the current source 145A through the first terminal or remote controller 160A. In the analog embodiment, the first dimming signal generator 520A, the control is selected by using the current feedback input 51 of the first terminal or remote controller 160A. The current feedback input 51 (e.g., into comparator 10 of FIG. 16) has a fixed threshold ($V_T$) to limit the LED 140 current at a fixed level. To regulate LED 140 current the signal at input 51 is supplied as a sum of the voltage drop across current sense resistor 402 and also across resistor 63. The voltage at the input 51 is then $V_{51}=V_{402}+V_{63}$, where $V_{402}$ is the voltage across resistor 402, and $V_{63}$ is the voltage across resistor 63.

As current feedback keeps $V_{51}$ equal to the threshold voltage $V_T$, then the LED 140 current, which is proportional to the voltage drop across resistor 402, will depend on $V_{63}$, which is $$V_{63}=(V_{68}-V_{402})*R_{63}/(R_{59}+R_{63}+R_{402})$$

The voltage signal $V_{63}$ is a fraction of voltage signal $V_{68}$ of output of operational amplifier 64. The divider of voltage $V_{68}$ is made by resistors 59, 63 and 402, having resistance values which are selected to provide, at the maximum of output voltage of the operational amplifier 64, a minimum, repeatable, flicker-free LED 140 current. For example, for an LED 140 having an average current of 400 mA, a maximum operational amplifier 68 voltage of 12 V, and a threshold voltage $V_T$=0.2V, then resistance values of resistors 59, 63 and 402 were set as 91K ohm, 1.6K ohm and 0.5 ohm, respectively. The control voltage at the output 68 of the operational amplifier 64 is shown on FIG. 19 as a function of voltage on lines 195A (line 54). In order to exclude non equal brightness at different LED bulbs and achieve the maximum range of brightness regulation at a given accuracy of current source 145A, a flat portion of the regulation characteristic 68A and 68B was introduced. As discussed above, when powered on, the central (host) power source 125 will provide an output voltage corresponding to a desired dimming level, which is the input voltage Vin to the terminal LED lighting apparatus 150A, and which varies between a minimum input voltage Vinmin and a maximum input voltage Vinmax, illustrated as line 251 (FIG. 4).

To get a desired output signal on line 68 of the operational amplifier 64 (e.g., $V_{68}$) as a function of input DC voltage Vin, the noninverting input 69 of the operational amplifier 64 is connected to the reference voltage 67, and its inverting input 70 is coupled to the input voltage Vin via a resistive divider 56, 57 with a dividing ratio satisfying the following equation:

$$(R_{56}+R_{57})/R_{57}=s_1*\left(\frac{V_{inmin}}{V_{ref}}\right),$$

where Vinmin is the minimum input power transmission line voltage as discussed above; $s_1$ is a coefficient to create a flat portion of the regulation characteristic at minimum input voltage (68A), the values of $s_1$ are from 0.95 to 0.99 (see FIG. 19).

Also the operational amplifier 64 has a negative feedback with resistor 58 such that the following equation is valid:

$$(s_2*(V_{outmax}-V_{outmin})*V_{inmin})/V_{ref}*(V_{inmax}-V_{inmin}))=(R_{56}+R_{57})*R_{58}/(R_{56}*R_{57}),$$

Where $R_{56}$, $R_{57}$, $R_{58}$ are resistors 56, 57 and 58 respectively, $V_{outmax}$ and $V_{outmin}$ respectively are the maximum and minimum output signal of the operational amplifier 64, $s_2$ is a coefficient between 1.05 to 1.1 to form a flat part (68B) of the regulation characteristics at the maximum input voltage (see FIG. 19).

When the input DC voltage is changing from $V_{inmin}$ to $V_{inmax}$ the output signal on line 68 of the operational amplifier 64 will be changing as shown in FIG. 19 from $V_{outmax}$, 68A to $V_{outmin}$, 68B with a certain flat regions at the beginning and at the end of characteristic. For example, for an input voltage changing from 40V to 47V the values of resistors $R_{56}$, $R_{57}$, $R_{58}$ were selected to be equal to 603K ohm, 189.6K ohm, and 1.1 M ohm, respectively.

A first exemplary or representative method of dimming consists of the following steps:

1. sensing the input voltage;
2. dividing the sensed signal by the ratio $$\frac{V_{inmin}}{V_{ref}};$$

3. introducing a flat portion of regulation characteristic at minimum input voltage by multiplying this ratio by a coefficient $s_1$, within 0.95-0.99, $$s_1 * \left(\frac{V_{inmin}}{V_{ref}}\right);$$

4. applying this signal to an inverting input of the operational amplifier;
5. applying a reference voltage to the noninverting input of the operational amplifier;

6A. keeping operational amplifier negative feedback to satisfy the following equation $$(V_{outmax}-V_{outmin})*V_{inmin})/V_{ref}*(V_{inmax}-V_{inmin}))=(R_{56}+R_{57})*R_{58}/(R_{56}*R_{57});$$

7. executing analog dimming signal by summing signals across resistors at the control input of the current source with the output signal of operational amplifier and negative feedback signal measured across current sense resistor; and
8. applying the executed analog dimming signal to the current feedback input of the current source A second exemplary or representative method of dimming will have some additional steps (6B) to compliment the first method. It introduces the flat portion of the regulation characteristic to equalize brightness of different co-located LED bulbs with different accuracy of current control, adding or substituting step 6B, consisting of:

6B. introducing a flat portion of the regulation characteristic by changing the operational amplifier feedback by modifying its gain by coefficient $s_2$ within 1.05-1.1.

$$(s_2*(V_{outmax}-V_{outmin})*V_{inmin})/V_{ref}*(V_{inmax}-V_{inmin}))=(R_{56}+R_{57})*R_{58}/(R_{56}*R_{57}).$$

Analog dimming allows a fairly wide range of change of the brightness of LEDs 140. Due to differences of LED characteristics, however, it is difficult to maintain the same brightness levels in a few co-located LED 140 bulbs. To solve that problem, in accordance with exemplary or representative embodiments, the depth of analog dimming is limited and PWM is introduced to change the brightness at low LED 140 current levels, providing the same average current to the LEDs 140, but using a lower or smaller duty cycle. A second dimming signal generator 520B is illustrated in FIG. 18, having combined analog and PWM control, and in addition to the components previously discussed with reference to FIG. 17 and dimming signal generator 520A, further comprises ramp generator 65, comparator 66, and resistor 61 (forming another voltage divider with resistor 60). The output of comparator 66 on line 73 is connected to a noninverting PWM dimming input 53 (illustrated as noninverting input of operational amplifier 13) of the first terminal or remote controller 160A. The PWM output of comparator 66 on line 73 typically has a frequency in the hundreds of Hz range, compared to the much higher frequency (typically kHz to MHz range) of the (buck) converter within the current source 145A.

Figure 20:
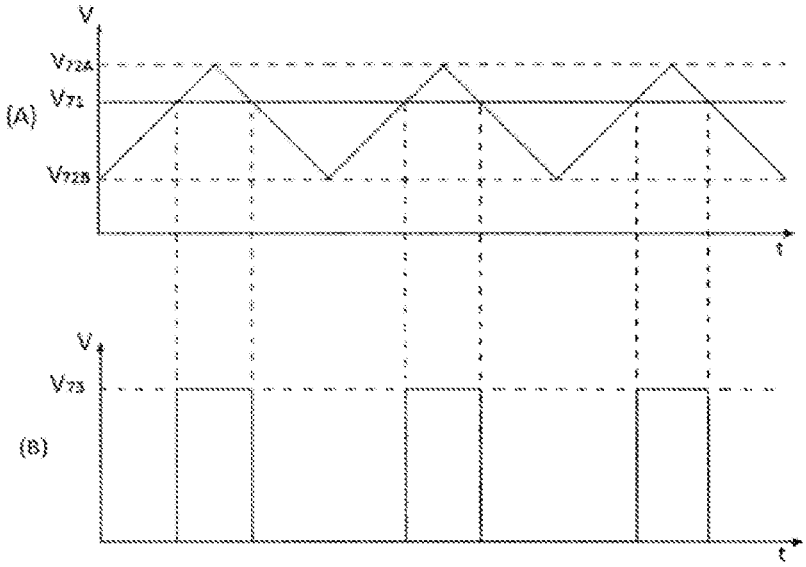
FIG. 20 is graphical diagram illustrating (a) a sawtooth waveform, and (b) a PWM signal.

FIG. 20 is graphical diagram illustrating (a) a sawtooth waveform, and (b) a PWM signal. As illustrated in FIG. 20, part (a), the sawtooth voltage is at the input 72 of comparator 66, with the PWM duty cycle controlled by a signal on line 71 (the inverting input of) comparator 66, and in part (b), a PWM waveform at the output 73 of the comparator 66. The output signal of the operational amplifier 64 on line 68, previously discussed, is also coupled to an inverting input 71 of the comparator 66 via a resistive divider (resistors 60, 61) with the gain $k*V_{outmax}=V_{sawtoothmax}$, where $V_{sawtoothmax}$ is the maximum value of the sawtooth voltage generated by a ramp generator 65 and applied to an noninverting input 72 of the comparator 66. The instantaneous value of the sawtooth signal is being kept between $k*V_{outmax}$ and $k*V_{outmin}$, being maximum $V_{sawtoothmax}$, illustrated at voltage level 72A in FIG. 20, and minimum $V_{sawtoothmin}$, illustrated at voltage level 72B in FIG. 20.

A third exemplary or representative method of dimming uses PWM control at low current levels of LEDs 140:

1. generating the output signal of the operational amplifier changing inversely proportional to the input voltage change within a set regulation range;
2. Dividing this signal by the ratio of maximum output of the operational amplifier signal to the amplitude of a sawtooth signal of the ramp generator, $k*V_{outmax}=V_{sawtoothmax}$;
3. Comparing this signal with a sawtooth signal generated by a ramp generator 65 at the PWM comparator 66 to produce a duty cycle of PWM to execute the regulation of LED 140 current/brightness;
4. Applying the generated PWM signal to a noninverting PWM dimming input 53 of the first terminal or remote controller 160A.

Figure 21:
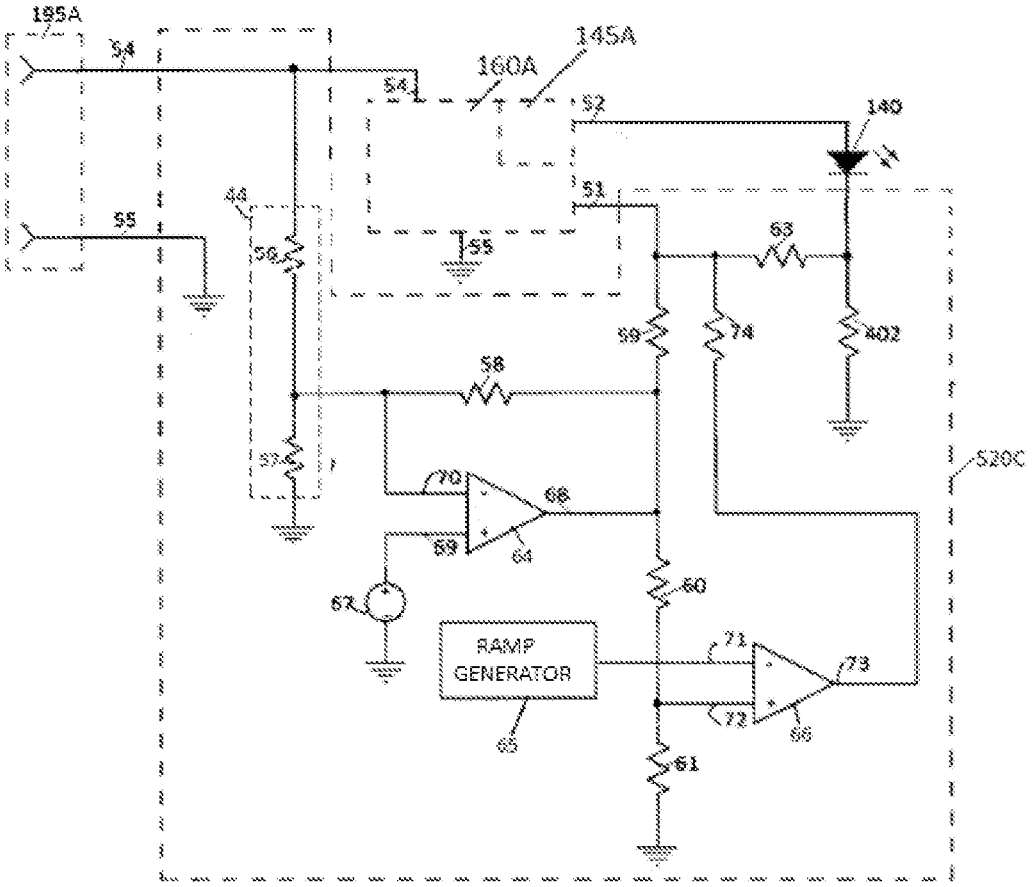
FIG. 21 is a block and circuit diagram illustrating a third dimming signal generator having combined analog and PWM control, in which the PWM is summed with the analog control signal.
Figure 22:
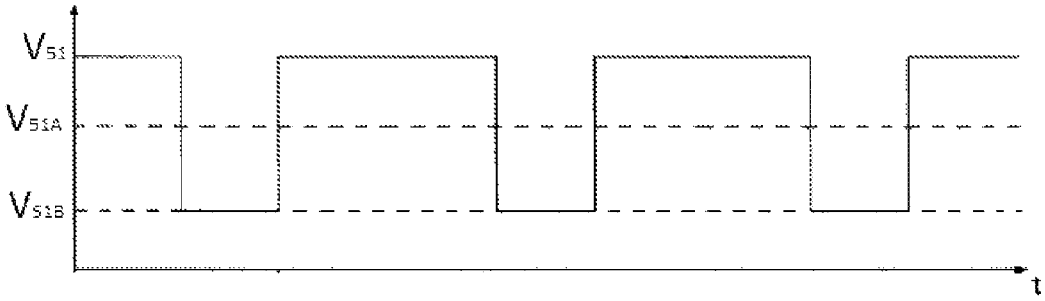
FIG. 22 illustrates an exemplary waveform of a PWM signal summed with the analog dimming signal.

In order to execute PWM dimming, there is no need to have a special PWM input at first terminal or remote controller 160A. FIG. 21 is a block and circuit diagram illustrating a third dimming signal generator 520C having combined analog and PWM control, in which the PWM is summed with the analog control signal in an exemplary or representative terminal LED lighting apparatus 150N, effectively providing a pulse for the analog control signal. The PWM comparator 66 is connected via resistor 74 to the (current) feedback input 51 of the first terminal or remote controller 160A. The value of resistor 74 is selected such that at a high output signal from the comparator 66 on line 73, the voltage drop on resistor 74 generated by current of the comparator 66 is adequate to shut down the current source 145A. For example, at a threshold of current feedback input 51 of 0.2 V, Vcc comparator 12.0V (internal to first terminal or remote controller 160A and not illustrated separately) and resistor 63 equal 1.6K ohm, the resistor 74 is selected to be 47K ohm, which provides for the current feedback signal to be almost two times higher than the threshold signal for input 51. The PWM control of the third dimming signal generator 520C is reversed, so the input 71 is connected to the output of the ramp generator 65 and input 72 is coupled to the connection point of the divider comprising resistors 60 and 61. FIG. 22 illustrates an exemplary waveform of a PWM signal summed with the analog dimming signal, at the input or node 51 of the first terminal or remote controller 160A: V51 is voltage level or signal at the input 51; V51A is the threshold of the current feedback input 51; and V51B is analog dimming signal at the input 51 of first terminal or remote controller 160A.

Figure 23:
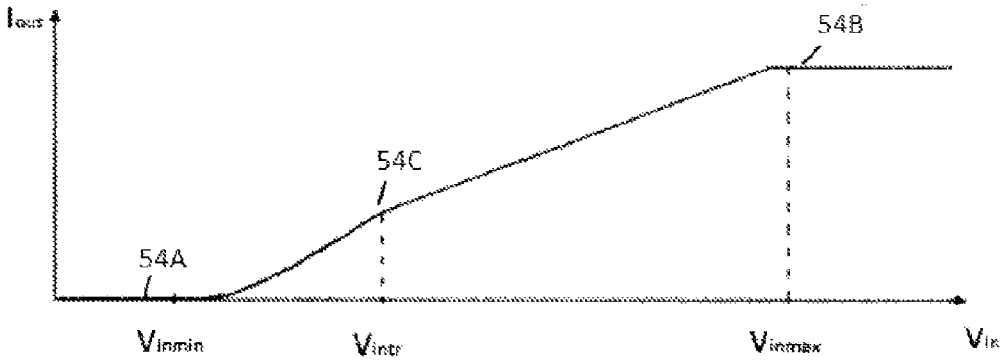
FIG. 23 is a graphical diagram illustrating a regulation characteristic of the third dimming signal generator with combined analog and PWM dimming regulation.

FIG. 23 is a graphical diagram illustrating a regulation characteristic of the third dimming signal generator 520C with combined analog and PWM dimming regulation, illustrating $I_{out}$, the output current of the current source 145A versus the input voltage Vin at line 54, $V_{inmin}$, 54A, the minimum input voltage; $V_{inmax}$, 54B, the maximum input voltage; and $V_{intr}$, 54C, the threshold input voltage, namely, the input voltage at which the combined (summed) PWM and analog dimming starts.

A fourth exemplary or representative method of dimming uses a combined analog and PWM control at low current levels of LEDs 140:

1. Generating the output signal of the operational amplifier changing inversely proportional to the input voltage change within a set regulation range and executing the analog dimming signal;

2. Applying the executed analog dimming signal to the current feedback input of the current source;

3. Generating a PWM signal by comparing a ramp generator signal with the output signal of the operational amplifier; and 4. Applying the generated PWM signal to the current feedback input of the current source, adding it to the analog dimming signal.

Figure 24:
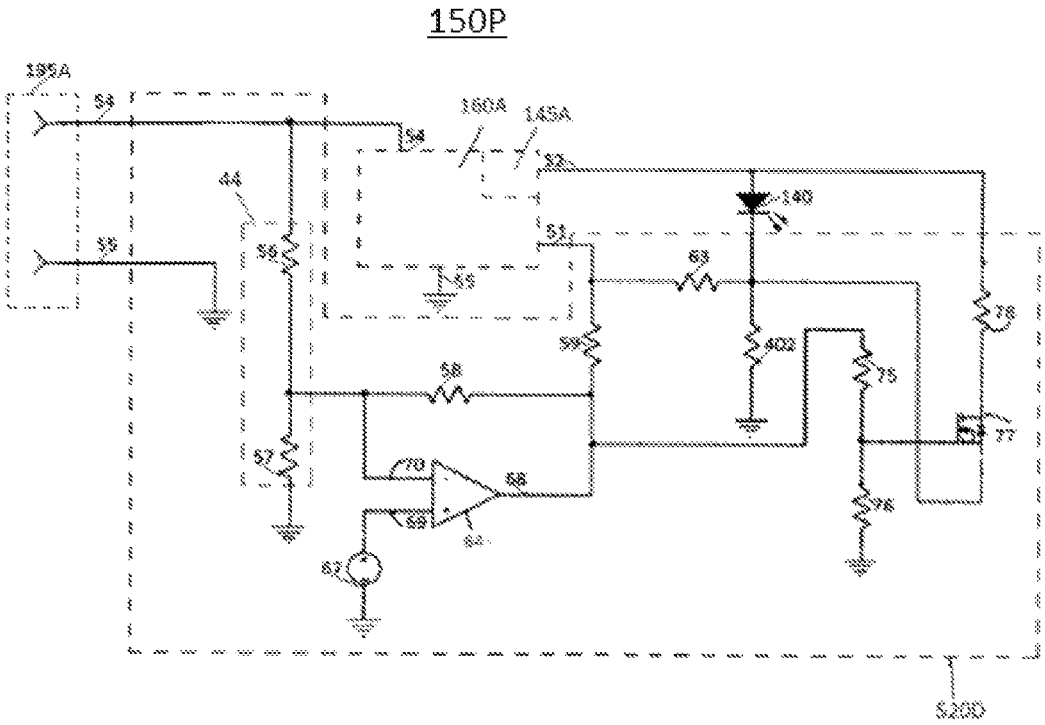
FIG. 24 is a block and circuit diagram illustrating an exemplary or representative fourth dimming signal generator with analog dimming regulation and a resistive network controlled by a MOSFET.

FIG. 24 is a block and circuit diagram illustrating an exemplary or representative fourth dimming signal generator 520D with analog dimming regulation and in parallel with LEDs 140, a resistive network (implemented using one or more resistors 78) controlled by a MOSFET 77 or another type of switch (e.g., bipolar transistor 79 of FIG. 25), in an exemplary or representative terminal LED lighting apparatus 150P. In order to increase the accuracy and stability of dimming at low LED 140 current levels, in accordance with an exemplary embodiment, part of the current from the LED 140 is diverted into a parallel, controlled resistive network (resistor 78) using a MOSFET 77. The MOSFET 77 is also driven by the output signal of the operational amplifier 64 divided by resistor network 75 and 76 (as another voltage divider). The values of resistors 75 and 76 are selected such that the MOSFET 77 is turning on gradually at about 0.7-0.9 $V_{outmax}$ or 70-90% of the output signal of the operational amplifier. For example, for MOSFET 77 with a gate threshold of 2.0 V the resistance value of resistor 75 is 1.0M ohm and resistor 76 is 300K ohm. Diverting LED 140 current into a parallel resistive network keeps the analog dimming signal applied to current feedback input higher than without parallel network and above noise signals, thereby making dimming regulation more stable.

Gradual turning on/off of the MOSFET 77 does not compromise the smoothness of dimming, as it is effectively invisible to the human eye. The extracting of LED 140 current is proportional to the conductance of the parallel network and LEDs 140. The conductance of the parallel network is established by a conductance of the field channel of the MOSFET 77 and a series connected current limiting resistor 78. The value of this resistor 78 sets the minimum LED 140 current. Minimum LED current would be defined by the targeted minimum LED brightness or minimum brightness without low DC current LED flickering. For example, for a network of 12 series connected LEDs 140 (about 36.0 V forward voltage) and dimming depth 1:2000, the resistance value of resistor 78 is selected as a 1.2K ohm resistor.

Figure 25:
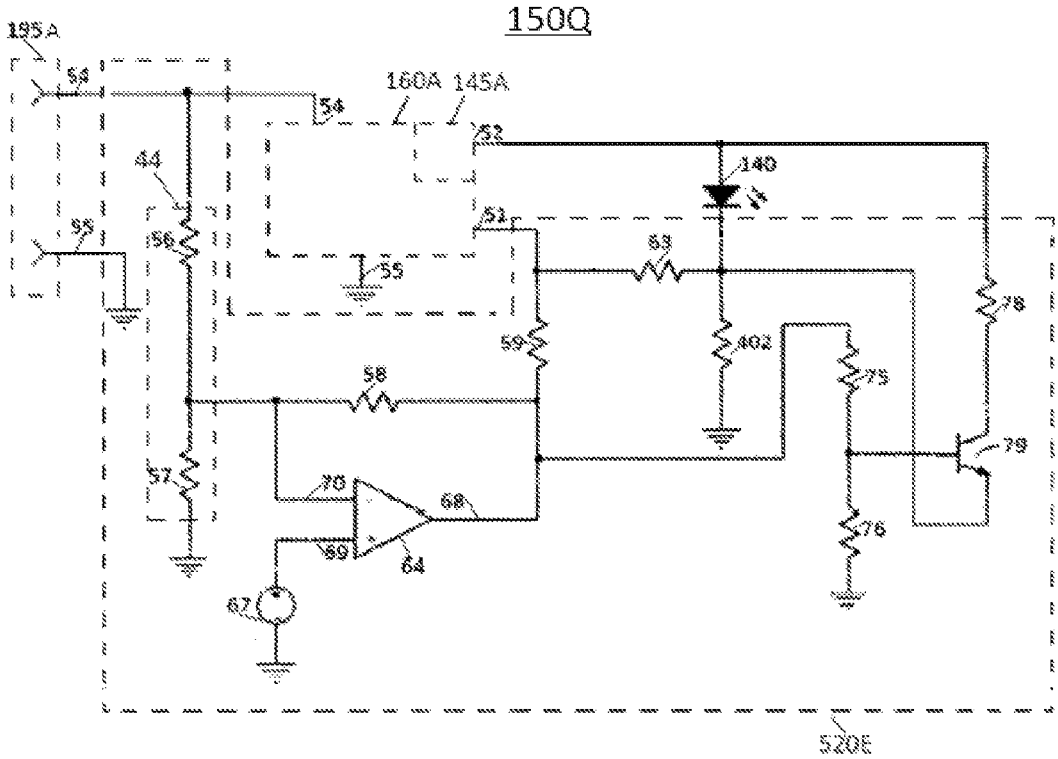
FIG. 25 is a block and circuit diagram illustrating an exemplary or representative fifth dimming signal generator with analog dimming regulation and a resistive network controlled by a bipolar transistor.

FIG. 25 is a block and circuit diagram illustrating an exemplary or representative fifth dimming signal generator 520E with analog dimming regulation and in parallel with LEDs 140, a resistive network controlled by a bipolar transistor 79, in an exemplary or representative terminal LED lighting apparatus 150Q, and functions effectively identically to the dimming signal generator 520D discussed above. The bipolar transistor 79 is also driven by the output signal of the operational amplifier 64 divided by resistor network or resistors 75 and 76. The resistance values of resistors 75 and 76 are also selected such that the bipolar transistor 79 is turning on gradually at about 0.7-0.9 $V_{outmax}$ or 70-90% of the output signal of the operational amplifier. For example, for a bipolar transistor 79 with a base-emitter threshold of 0.6 V, the resistance value of resistor 75 is 510K ohm and resistor 76 is 51K ohm. The extracting of LED 140 current is also proportional to the conductance of parallel network and LEDs 140. The conductance of the parallel network is established by a conductance of the emitter-collector of the bipolar transistor 79 and a series connected current limiting resistor 78. The value of this resistor sets the minimum LED current. Minimum LED current would be defined by the targeted minimum LED brightness or minimum brightness without low DC current LED flickering. For example for a network of 12 series connected LEDs (about 36.0 V forward voltage) and dimming depth 1:2000, the resistance value of resistor 78 is selected as 1.1K ohms.

Figure 26:
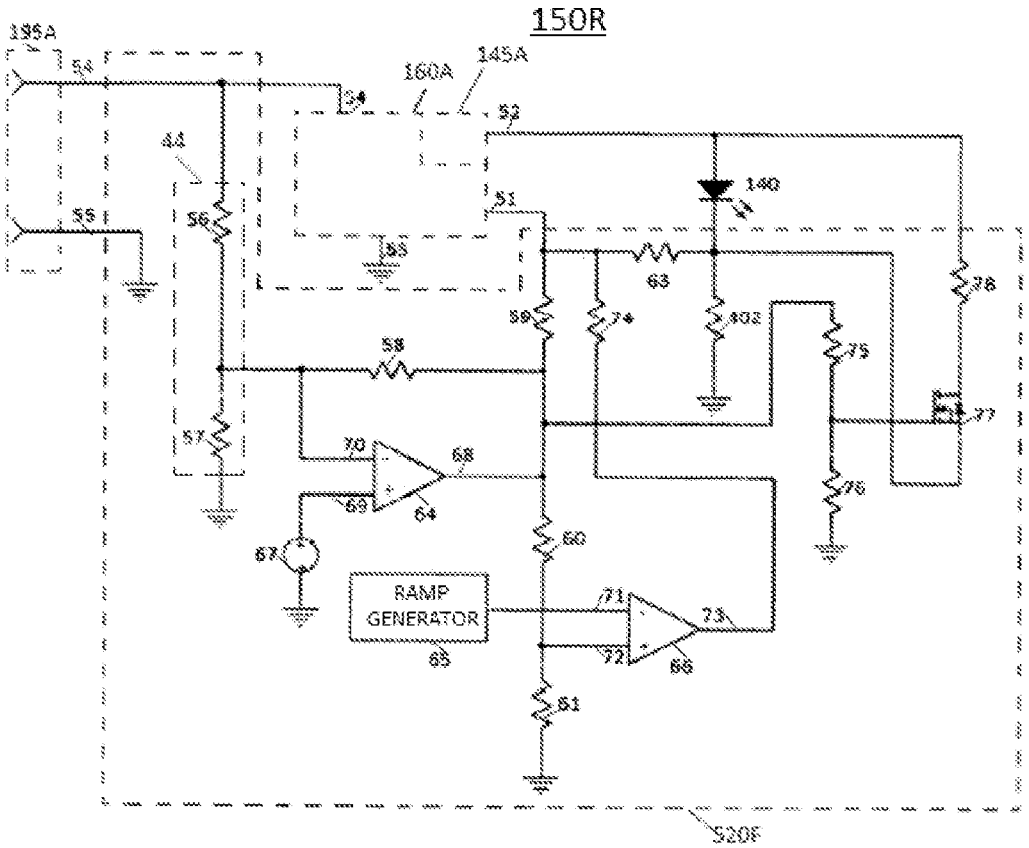
FIG. 26 is a block and circuit diagram illustrating an exemplary or representative sixth dimming signal generator having combined analog and PWM control, in which the PWM is summed with the analog control signal, and a resistive network controlled by a MOSFET.
Figure 27:
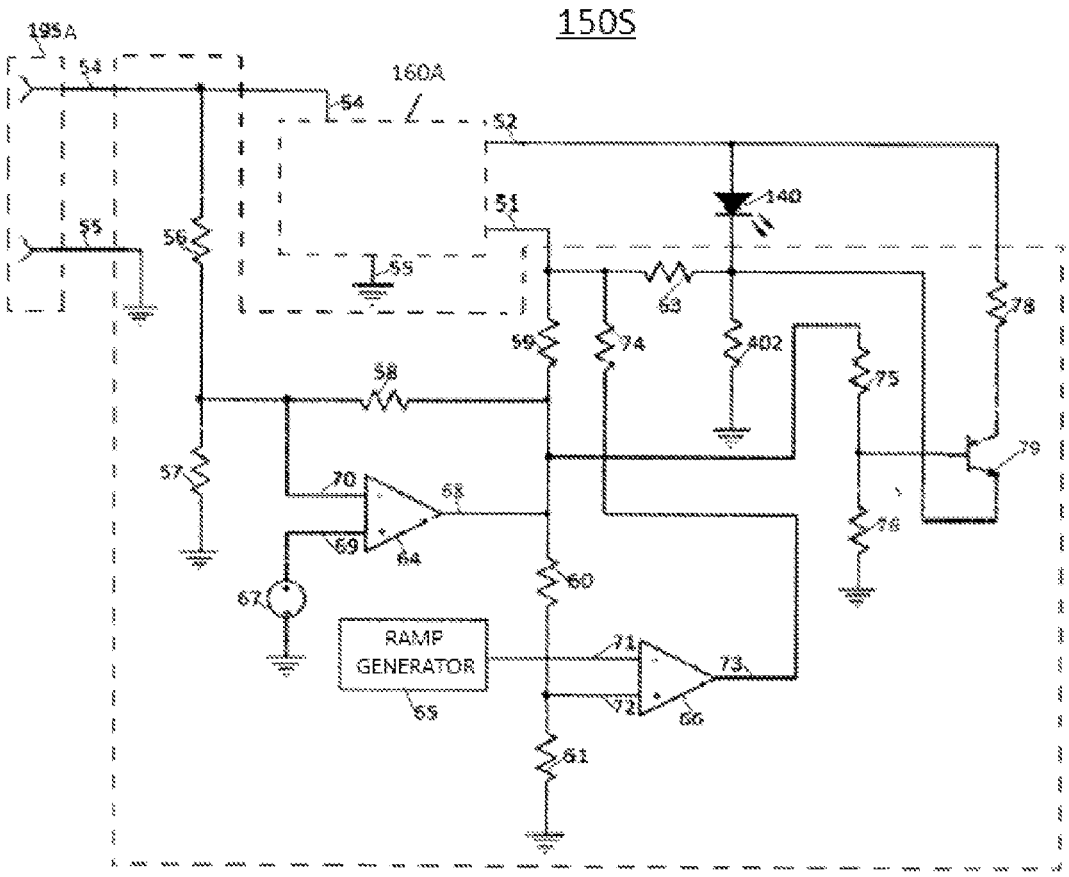
FIG. 27 is a block and circuit diagram illustrating an exemplary or representative seventh dimming signal generator having combined analog and PWM control, in which the PWM is summed with the analog control signal, and a resistive network controlled by a bipolar transistor.

FIG. 26 is a block and circuit diagram illustrating an exemplary or representative sixth dimming signal generator 520F having combined analog and PWM control, in which the PWM is summed with the analog control signal, and in parallel with LEDs 140, a resistive network controlled by a MOSFET 77, in an exemplary or representative terminal LED lighting apparatus 150R. FIG. 27 is a block and circuit diagram illustrating an exemplary or representative seventh dimming signal generator 520G having combined analog and PWM control, in which the PWM is summed with the analog control signal, and in parallel with LEDs 140, a resistive network controlled by a bipolar transistor 79, in an exemplary or representative terminal LED lighting apparatus 150S. The analog dimming is executed by the operational amplifier 64 and PWM dimming by ramp generator 65 and PWM comparator 66. The parallel resistive network operate as previously described with reference to FIGS. 24 and 25.

Figure 28:
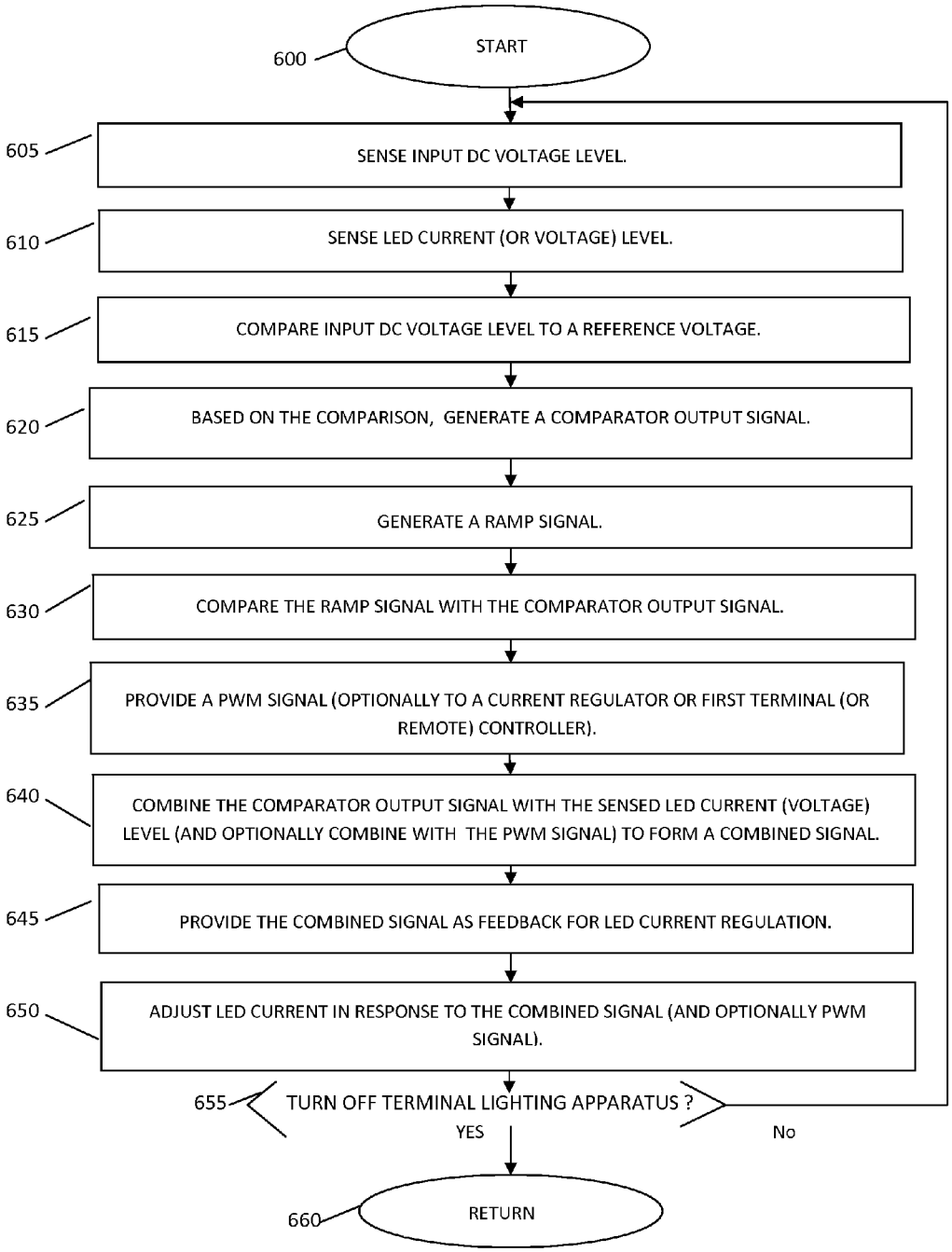
FIG. 28 is a flow diagram illustrating a method of providing dimming regulation.

FIG. 28 is a flow diagram illustrating a method of providing dimming regulation, and is a useful summary. Beginning with start step 600, the method senses the input DC voltage level, step 605, such as by using a voltage divider (resistors 56, 57), and senses the LED 140 current level, step 610, such as by using a current sense resistor 402 and measuring or sensing the corresponding voltage level. The input DC voltage level is compared to a reference voltage level, step 615, and a corresponding comparison output signal is generated, step 620, such as by a comparator 64. As an option, a ramp (or sawtooth) signal is also generated, step 625, such as by ramp generator 65, and the ramp signal is compared with the comparison output signal, step 630, such as by comparator 66, also as an option. A PWM signal is generated from the ramp signal comparison, step 635, which optionally also may be provided to the current regulator (145A) providing current to the LEDs 140 or to the first terminal or remote controller 160A controlling the current regulator 145A. The comparison output signal is combined with the sensed LED current level (e.g., as a summed voltage across resistors 63 and 402), and potentially also combined with the PWM signal in various embodiments, to form a combined signal, step 640. The combined signal is then provided as feedback for LED 140 current regulation, step 645, such as at node or line 51, and optionally in step 645, the PWM signal may be provided as a separate signal for LED 140 current regulation. In response, the LED 140 current may be adjusted, step 650. The method may continue iteratively, returning to step 605, or when the terminal lighting apparatus 150 is turned off, step 655, the method may end, return step 660.

It should be noted that as may be apparent to those having skill in the electronic arts, various components may be substituted equivalently for those illustrated in the various Figures. For example, comparators may be substituted for operational amplifiers 64, 66, and other types of voltage and current sensors may be utilized as well. All such variations are considered equivalent and within the scope of the present disclosure.

The present disclosure is to be considered as an exemplification of the principles of the invention and is not intended to limit the invention to the specific embodiments illustrated. In this respect, it is to be understood that the invention is not limited in its application to the details of construction and to the arrangements of components set forth above and below, illustrated in the drawings, or as described in the examples. Systems, methods and apparatuses consistent with the present invention are capable of other embodiments and of being practiced and carried out in various ways.

Although the invention has been described with respect to specific embodiments thereof, these embodiments are merely illustrative and not restrictive of the invention. In the description herein, numerous specific details are provided, such as examples of electronic components, electronic and structural connections, materials, and structural variations, to provide a thorough understanding of embodiments of the present invention. One skilled in the relevant art will recognize, however, that an embodiment of the invention can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present invention. In addition, the various Figures are not drawn to scale and should not be regarded as limiting.

Those having skill in the electronic arts will recognize that the various single-stage or two-stage converters may be implemented in a wide variety of ways, in addition to those illustrated, such as flyback, buck, boost, and buck-boost, for example and without limitation, and may be operated in any number of modes (discontinuous current mode, continuous current mode, and critical conduction mode), any and all of which are considered equivalent and within the scope of the present invention.

Reference throughout this specification to "one embodiment", "an embodiment", or a specific "embodiment" means that a particular feature, structure, or characteristic described in connection with the embodiment is included in at least one embodiment of the present invention and not necessarily in all embodiments, and further, are not necessarily referring to the same embodiment. Furthermore, the particular features, structures, or characteristics of any specific embodiment of the present invention may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

It will also be appreciated that one or more of the elements depicted in the Figures can also be implemented in a more separate or integrated manner, or even removed or rendered inoperable in certain cases, as may be useful in accordance with a particular application. Integrally formed combinations of components are also within the scope of the invention, particularly for embodiments in which a separation or combination of discrete components is unclear or indiscernible. In addition, use of the term "coupled" herein, including in its various forms such as "coupling" or "couplable", means and includes any direct or indirect electrical, structural or magnetic coupling, connection or attachment, or adaptation or capability for such a direct or indirect electrical, structural or magnetic coupling, connection or attachment, including integrally formed components and components which are coupled via or through another component.

As used herein for purposes of the present invention, the term "LED" and its plural form "LEDs" should be understood to include any electroluminescent diode or other type of carrier injection- or junction-based system which is capable of generating radiation in response to an electrical signal, including without limitation, various semiconductor- or carbon-based structures which emit light in response to a current or voltage, light emitting polymers, organic LEDs, and so on, including within the visible spectrum, or other spectra such as ultraviolet or infrared, of any bandwidth, or of any color or color temperature.

A "controller" or "processor" 120, 160 may be any type of controller or processor circuitry, and may be embodied as one or more controllers 120, 160 configured, designed, programmed or otherwise adapted to perform the functionality discussed herein, using any selected or desired analog or digital circuitry, such as using one or more comparators, operational amplifiers, integrators, capacitors, resistors, switches, digital logic, etc. (not separately illustrated), for example and without limitation, as generally known in the electronic and electrical arts. As the term controller or processor is used herein, a controller 120, 160, may include use of a single integrated circuit ("IC"), or may include use of a plurality of integrated circuits or other components connected, arranged or grouped together, such as controllers, microprocessors, digital signal processors ("DSPs"), parallel processors, multiple core processors, custom ICs, application specific integrated circuits ("ASICs"), field programmable gate arrays ("FPGAs"), adaptive computing ICs, associated memory (such as RAM, DRAM and ROM), and other ICs and components, whether analog or digital. As a consequence, as used herein, the term controller (or processor) should be understood to equivalently mean and include a single IC, or arrangement of custom ICs, ASICs, processors, microprocessors, controllers, FPGAs, adaptive computing ICs, or some other grouping of integrated circuits which perform the functions discussed below, with associated memory, such as microprocessor memory or additional RAM, DRAM, SDRAM, SRAM, MRAM, ROM, FLASH, EPROM or EPROM. A controller (or processor) (such as controller 120, 160), with its associated memory, may be adapted or configured (via programming, FPGA interconnection, or hard-wiring) to perform the methodology of the invention, as discussed below. For example, the methodology may be programmed and stored, in a controller 120, 160 with its associated memory (and/or memory 115) and other equivalent components, as a set of program instructions or other code (or equivalent configuration or other program) for subsequent execution when the processor is operative (i.e., powered on and functioning). Equivalently, when the controller 120, 160 may implemented in whole or part as FPGAs, custom ICs and/or ASICs, the FPGAs, custom ICs or ASICs also may be designed, configured and/or hard-wired to implement the methodology of the invention. For example, the controller 120, 160 may be implemented as an arrangement of analog and/or digital circuits, controllers, microprocessors, DSPs and/or ASICs, collectively referred to as a "controller", which are respectively hard-wired, programmed, designed, adapted or configured to implement the methodology of the invention, including possibly in conjunction with a memory 115.

The optional memory 115, which may include a data repository (or database), may be embodied in any number of forms, including within any computer or other machine-readable data storage medium, memory device or other storage or communication device for storage or communication of information, currently known or which becomes available in the future, including, but not limited to, a memory integrated circuit ("IC"), or memory portion of an integrated circuit (such as the resident memory within a controller 120, 160 or processor IC), whether volatile or non-volatile, whether removable or non-removable, including without limitation RAM, FLASH, DRAM, SDRAM, SRAM, MRAM, FeRAM, ROM, EPROM or EPROM, or any other form of memory device, such as a magnetic hard drive, an optical drive, a magnetic disk or tape drive, a hard disk drive, other machine-readable storage or memory media such as a floppy disk, a CDROM, a CD-RW, digital versatile disk (DVD) or other optical memory, or any other type of memory, storage medium, or data storage apparatus or circuit, which is known or which becomes known, depending upon the selected embodiment. The memory 115 may be adapted to store various look up tables, parameters, coefficients, other information and data, programs or instructions (of the software of the present invention), and other types of tables such as database tables.

As indicated above, the controller 120, 160 is hard-wired or programmed, using software and data structures of the invention, for example, to perform the methodology of the present invention. As a consequence, the system and method of the present invention may be embodied as software which provides such programming or other instructions, such as a set of instructions and/or metadata embodied within a non-transitory computer readable medium, discussed above. In addition, metadata may also be utilized to define the various data structures of a look up table or a database. Such software may be in the form of source or object code, by way of example and without limitation. Source code further may be compiled into some form of instructions or object code (including assembly language instructions or configuration information). The software, source code or metadata of the present invention may be embodied as any type of code, such as C, C++, SystemC, LISA, XML, Java, Brew, SQL and its variations (e.g., SQL 99 or proprietary versions of SQL), DB2, Oracle, or any other type of programming language which performs the functionality discussed herein, including various hardware definition or hardware modeling languages (e.g., Verilog, VHDL, RTL) and resulting database files (e.g., GDSII). As a consequence, a "construct", "program construct", "software construct" or "software", as used equivalently herein, means and refers to any programming language, of any kind, with any syntax or signatures, which provides or can be interpreted to provide the associated functionality or methodology specified (when instantiated or loaded into a processor or computer and executed, including the controller 120, 160 for example).

The software, metadata, or other source code of the present invention and any resulting bit file (object code, database, or look up table) may be embodied within any tangible, non-transitory storage medium, such as any of the computer or other machine-readable data storage media, as computer-readable instructions, data structures, program modules or other data, such as discussed above with respect to the memory 160, e.g., a floppy disk, a CDROM, a CD-RW, a DVD, a magnetic hard drive, an optical drive, or any other type of data storage apparatus or medium, as mentioned above.

In the foregoing description and in the Figures, sense resistors are shown in exemplary configurations and locations; however, those skilled in the art will recognize that other types and configurations of sensors may also be used and that sensors may be placed in other locations. Alternate sensor configurations and placements are within the scope of the present invention.

As used herein, the term "DC" denotes both fluctuating DC (such as is obtained from rectified AC) and constant voltage DC (such as is obtained from a battery, voltage regulator, or power filtered with a capacitor). As used herein, the term "AC" denotes any form of alternating current with any waveform (sinusoidal, sine squared, rectified sinusoidal, square, rectangular, triangular, sawtooth, irregular, etc.) and with any DC offset and may include any variation such as chopped or forward- or reverse-phase modulated alternating current, such as from a dimmer switch.

With respect to sensors, we refer herein to parameters that "represent" a given metric or are "representative" of a given metric, where a metric is a measure of a state of at least part of the regulator or its inputs or outputs. A parameter is considered to represent a metric if it is related to the metric directly enough that regulating the parameter will satisfactorily regulate the metric. For example, the metric of LED current may be represented by an inductor current because they are similar and because regulating an inductor current satisfactorily regulates LED current. A parameter may be considered to be an acceptable representation of a metric if it represents a multiple or fraction of the metric. It is to be noted that a parameter may physically be a voltage and yet still represents a current value. For example, the voltage across a sense resistor "represents" current through the resistor.

In the foregoing description of illustrative embodiments and in attached figures where diodes are shown, it is to be understood that synchronous diodes or synchronous rectifiers (for example relays or MOSFETs or other transistors switched off and on by a control signal) or other types of diodes may be used in place of standard diodes within the scope of the present invention. Exemplary embodiments presented here generally generate a positive output voltage with respect to ground; however, the teachings of the present invention apply also to power converters that generate a negative output voltage, where complementary topologies may be constructed by reversing the polarity of semiconductors and other polarized components.

For convenience in notation and description, a transformers may be referred to as a "transformer," although in illustrative embodiments, it may behave in many respects also as an inductor. Similarly, inductors, using methods known in the art, can, under proper conditions, be replaced by transformers. We refer to transformers and inductors as "inductive" or "magnetic" elements, with the understanding that they perform similar functions and may be interchanged within the scope of the present invention.

Furthermore, any signal arrows in the drawings/Figures should be considered only exemplary, and not limiting, unless otherwise specifically noted. Combinations of components of steps will also be considered within the scope of the present invention, particularly where the ability to separate or combine is unclear or foreseeable. The disjunctive term "or", as used herein and throughout the claims that follow, is generally intended to mean "and/or", having both conjunctive and disjunctive meanings (and is not confined to an "exclusive or" meaning), unless otherwise indicated. As used in the description herein and throughout the claims that follow, "a", "an", and "the" include plural references unless the context clearly dictates otherwise. Also as used in the description herein and throughout the claims that follow, the meaning of "in" includes "in" and "on" unless the context clearly dictates otherwise.

The foregoing description of illustrated embodiments of the present invention, including what is described in the summary or in the abstract, is not intended to be exhaustive or to limit the invention to the precise forms disclosed herein. From the foregoing, it will be observed that numerous variations, modifications and substitutions are intended and may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

It is claimed:

1. A dimming signal generator coupleable to a controller or a current generator for a plurality of light emitting diodes (LEDs), the dimming signal generator comprising:

a first resistive voltage divider to sense an input DC voltage;

a current sensor to sense a current level of the plurality of LEDs;

a first operational amplifier coupled to the first resistive voltage divider, the first operational amplifier to compare the sensed input DC voltage to a reference voltage level, and to provide a comparator output signal; and a current path coupled to an output of the first operational amplifier to combine the comparator output signal with the sensed LED current level to provide a combined signal for current level feedback for control of the LED current level.

2. The dimming signal generator of claim 1, further comprising:

a ramp signal generator; and a second operational amplifier coupled to the ramp signal generator and to the output of the first operational amplifier, the second operational amplifier to provide a pulse width modulated signal.

3. The dimming signal generator of claim 2, wherein the second operational amplifier is further coupled to an input of the controller to provide the pulse width modulated signal directly to the controller for pulse width modulation of the LED current.

4. The dimming signal generator of claim 2, wherein the second operational amplifier is further coupled to the current path to combine the pulse width modulated signal into the combined signal.

5. The dimming signal generator of claim 2, wherein the second operational amplifier is to compare the ramp signal with the comparator output signal to generate the pulse width modulated signal.

6. The dimming signal generator of claim 1, further comprising:

a resistive network coupleable in parallel with the plurality of LEDs;

a second resistive voltage divider coupled to the output of the first operational amplifier; and a switch coupled to the resistive network and to the second resistive voltage divider to divert current from the plurality of LEDs in response to the comparator output signal.

7. The dimming signal generator of claim 6, wherein the switch is a MOSFET or a bipolar transistor.

8. The dimming signal generator of claim 1, wherein the comparator output signal is inversely proportional to the sensed input DC voltage level.

9. The dimming signal generator of claim 1, wherein the combined signal is greater than the sensed LED current level to cause a decrease in the LED current level and provide dimming of the LEDs.

10. A dimming signal generator coupleable to a controller or a current generator for a plurality of light emitting diodes (LEDs), the dimming signal generator comprising:

a first resistive voltage divider to sense an input DC voltage;

a current sensor to sense a current level of the plurality of LEDs;

a first operational amplifier coupled to the first resistive voltage divider, the first operational amplifier to compare the sensed input DC voltage to a reference voltage level, and to provide a comparator output signal;

a ramp signal generator;

a second operational amplifier coupled to the ramp signal generator and to the output of the first operational amplifier, the second operational amplifier to compare the ramp signal with the comparator output signal to generate a pulse width modulated signal; and a current path coupled to an output of the first operational amplifier to combine the comparator output signal with the sensed LED current level to provide a combined signal for current level feedback for control of the LED current level.

11. The dimming signal generator of claim 10, wherein the second operational amplifier is further coupled to an input of the controller to provide the pulse width modulated signal directly to the controller for pulse width modulation of the LED current.

12. The dimming signal generator of claim 10, wherein the second operational amplifier is further coupled to the current path to combine the pulse width modulated signal into the combined signal.

13. The dimming signal generator of claim 10, further comprising:

a resistive network coupleable in parallel with the plurality of LEDs;

a second resistive voltage divider coupled to the output of the first operational amplifier; and a switch coupled to the resistive network and to the second resistive voltage divider to divert current from the plurality of LEDs in response to the comparator output signal.

14. The dimming signal generator of claim 13, wherein the switch is a MOSFET or a bipolar transistor.

15. A light emitting apparatus comprising:

a plurality of light emitting diodes (LEDs);

a current generator coupled to the plurality of LEDs;

a controller coupled to the current generator; and a dimming signal generator coupled to the controller, the dimming signal generator to provide a combined signal for current level feedback for control of the LED current level.

16. The light emitting apparatus of claim 15, wherein the dimming signal generator further comprises:

a first resistive voltage divider to sense an input DC voltage;

a current sensor to sense a current level of the plurality of LEDs;

a first operational amplifier coupled to the first resistive voltage divider, the first operational amplifier to compare the sensed input DC voltage to a reference voltage level, and to provide a comparator output signal; and a current path coupled to an output of the first operational amplifier to combine the comparator output signal with the sensed LED current level to provide the combined signal.

17. The light emitting apparatus of claim 16, wherein the dimming signal generator further comprises:

a ramp signal generator; and a second operational amplifier coupled to the ramp signal generator and to the output of the first operational amplifier, the second operational amplifier to provide a pulse width modulated signal.

18. The light emitting apparatus of claim 17, wherein the second operational amplifier is further coupled to the current path to combine the pulse width modulated signal into the combined signal.

19. The light emitting apparatus of claim 16, wherein the dimming signal generator further comprises:

a resistive network coupleable in parallel with the plurality of LEDs;

a second resistive voltage divider coupled to the output of the first operational amplifier; and a switch coupled to the resistive network and to the second resistive voltage divider to divert current from the plurality of LEDs in response to the comparator output signal.

20. A method of providing brightness dimming of a plurality of light emitting diodes (LEDs), the method comprising:

sensing an input DC voltage level;

sensing an LED current level;

using a first operational amplifier, comparing the input DC voltage level to a reference voltage and generating a comparator output signal;

combining the comparator output signal with the sensed LED current level and pulse width modulation signal to form a combined signal;

providing the combined signal as feedback for LED current regulation; and adjusting the LED current in response to the combined signal.

21. The method of claim 20, further comprising:

generating a ramp signal;

using a second operational amplifier, generating a pulse width modulation signal.

22. The method of claim 21, further comprising:

providing the pulse width modulated signal directly to a controller for pulse width modulation of the LED current.

23. The method of claim 21, further comprising:

combining the pulse width modulated signal into the combined signal.

24. The method of claim 21, wherein the step of generating the pulse width modulation signal further comprises comparing the ramp signal with the comparator output signal.

25. The method of claim 20, further comprising:

using a switch, diverting current from the plurality of LEDs in response to the comparator output signal.

* * * * *